US012523111B2

(12) United States Patent
LaChance et al.

(10) Patent No.: US 12,523,111 B2
(45) Date of Patent: Jan. 13, 2026

(54) CASING RUNNING ROTARY INSERTS

(71) Applicant: Chevron U.S.A. Inc., San Ramon, CA (US)

(72) Inventors: Robert Joseph LaChance, Odessa, TX (US); Colburn Bernard Summers, Walnut Grove, MS (US); Andrew James Wilson, Spring, TX (US); Tyler Chance Vanderslice, Odessa, TX (US); Jonathan Michael Moore, Seminary, MS (US); Clint Edward Concord, Magnolia, TX (US); Jacqueline Marie Smith, Kemah, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 18/793,410

(22) Filed: Aug. 2, 2024

(65) Prior Publication Data

US 2025/0043649 A1 Feb. 6, 2025

Related U.S. Application Data

(60) Provisional application No. 63/517,241, filed on Aug. 2, 2023.

(51) Int. Cl.
*E21B 33/04* (2006.01)

(52) U.S. Cl.
CPC ..... *E21B 33/0415* (2013.01)

(58) Field of Classification Search
CPC ..... E21B 33/0415; E21B 33/0422
See application file for complete search history.

(56) References Cited

U.S. PATENT DOCUMENTS 2,739,790 A * 3/1956 Ball ..... E21B 19/16 24/265 H
3,130,987 A * 4/1964 Johnson ..... E21B 33/0422 285/123.8
3,720,261 A * 3/1973 Heilhecker ..... E21B 33/0415 166/208
3,748,702 A * 7/1973 Brown ..... E21B 19/10 188/67
4,476,936 A * 10/1984 Boyadjieff ..... E21B 19/00 166/383

(Continued)

*Primary Examiner* — Shane Bomar
(74) *Attorney, Agent, or Firm* — Smith & Woldesenbet Law Group, PLLC

(57) ABSTRACT

A casing running rotary insert can include a base having a first aperture that traverses therethrough. The casing running rotary insert can also include a rotary table engagement feature that extends from a bottom surface of the base, where the rotary table engagement feature is configured to engage a complementary feature of a rotary table to fix a position of the base relative to the rotary table, and where the aperture in the base is configured to align with a second aperture in the rotary table when the rotary table engagement feature is engaged with the complementary feature of the rotary table. The casing running rotary insert can further include a casing bowl engagement feature that extends from a top surface of the base, where the casing bowl engagement feature is configured to engage a casing bowl to fix a position of the casing bowl relative to the base.

20 Claims, 16 Drawing Sheets

(56) References Cited

U.S. PATENT DOCUMENTS

| | | | | |
|---|---|---|---|---|
| 6,192,981 | B1 * | 2/2001 | Boquet | E21B 19/10 188/67 |
| 9,249,634 | B1 * | 2/2016 | Streety | E21B 19/00 |
| 12,241,328 | B1 * | 3/2025 | Hashmi | E21B 19/24 |
| 2003/0116326 | A1 * | 6/2003 | Dallas | E21B 33/0422 166/382 |
| 2007/0012486 | A1 * | 1/2007 | McGuire | E21B 33/0422 166/77.52 |
| 2018/0187502 | A1 * | 7/2018 | Cridland | E21B 23/0411 |

* cited by examiner

CASING RUNNING ROTARY INSERTS

CROSS-REFERENCE TO RELATED APPLICATIONS

This application claims priority under 35 U.S.C. § 119 to U.S. Provisional Patent Application Ser. No. 63/517,241, titled "Casing Running Rotary Inserts" and filed on Aug. 2, 2023, the entire contents of which are hereby incorporated herein by reference.

TECHNICAL FIELD

The present invention is directed to casing running rotary inserts, and more particularly, to surface and intermediate hole section casing running bowl rotary lock boxes, for use while running casing on land rigs, to improve performance and improve safety of casing running and rig operations.

BACKGROUND

While running casing into a borehole during drilling operations, generally a surface and intermediate hole section casing bowl and three to four heavy duty stability chains are used to anchor the bowl. The bowl is typically used to hold and run the casing during casing running operations, and the chains prevent the bowl from rotating with the force of the pipe (casing) being screwed together. In many cases however, there is non-productive time by having to re-screw, or make-up, pipe due to this bowl movement and to readjust for the slack in the chains. The chains, which are used to prevent as much movement as possible, can also act as a trip hazard during the operation.

Therefore, there is a need for an improved system for safely minimizing movement of the surface and intermediate hole section casing bowl during drilling operations.

SUMMARY

In general, in one aspect, the disclosure relates to a casing running rotary insert that includes a base having a first aperture that traverses therethrough. The casing running rotary insert can also include a rotary table engagement feature that extends from a bottom surface of the base, where the rotary table engagement feature is configured to engage a complementary feature of a rotary table to fix a position of the base relative to the rotary table, and where the aperture in the base is configured to align with a second aperture in the rotary table when the rotary table engagement feature is engaged with the complementary feature of the rotary table. The casing running rotary insert can further include a casing bowl engagement feature that extends from a top surface of the base, where the casing bowl engagement feature is configured to engage a casing bowl to fix a position of the casing bowl relative to the base.

In other aspects, the disclosure relates to a casing running rotary insert assembly that can include a casing bowl having a height, a length, a width, and a first aperture that traverses therethrough along the height. The casing running rotary insert assembly can also include a casing running rotary insert, which can include a base having a second aperture that traverses therethrough. The casing running rotary insert of the casing running rotary insert assembly can also include a rotary table engagement feature that extends from a bottom surface of the base, where the rotary table engagement feature is configured to engage a complementary feature of a rotary table to fix a position of the base relative to the rotary table, and where the second aperture in the base is configured to align with a third aperture in the rotary table when the rotary table engagement feature is engaged with the complementary feature of the rotary table. The casing running rotary insert of the casing running rotary insert assembly can further include a casing bowl engagement feature that extends from a top surface of the base, where the casing bowl engagement feature is configured to engage the casing bowl to fix a position of the casing bowl relative to the base, and wherein the first aperture and the second aperture align with each other when the casing bowl engagement feature engages the casing bowl.

In yet other aspects, the disclosure relates to a casing string manipulation system that includes a casing bowl having a height, a length, a width, and a first aperture that traverses therethrough along the height. The casing string manipulation system can also include a rotary table having a second aperture that traverses therethrough and a casing running rotary insert engagement feature. The casing string manipulation system can further include a casing running rotary insert, which can include a base having a third aperture that traverses therethrough. The casing running rotary insert of the casing string manipulation system can also include a rotary table engagement feature that extends from a bottom surface of the base, where the rotary table engagement feature is configured to engage the casing running rotary insert engagement feature of the rotary table to fix a position of the base relative to the rotary table, and where the third aperture in the base is configured to align with the second aperture in the rotary table when the rotary table engagement feature is engaged with the casing running rotary insert engagement feature of the rotary table. The casing running rotary insert of the casing string manipulation system can further include a casing bowl engagement feature that extends from a top surface of the base, where the casing bowl engagement feature is configured to engage the casing bowl to fix a position of the casing bowl relative to the base, and wherein the first aperture and the third aperture align with each other when the casing bowl engagement feature engages the casing bowl.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, the same reference numerals used in different figures may designate like or corresponding but not necessarily identical elements.

DETAILED DESCRIPTION

Figure 1:
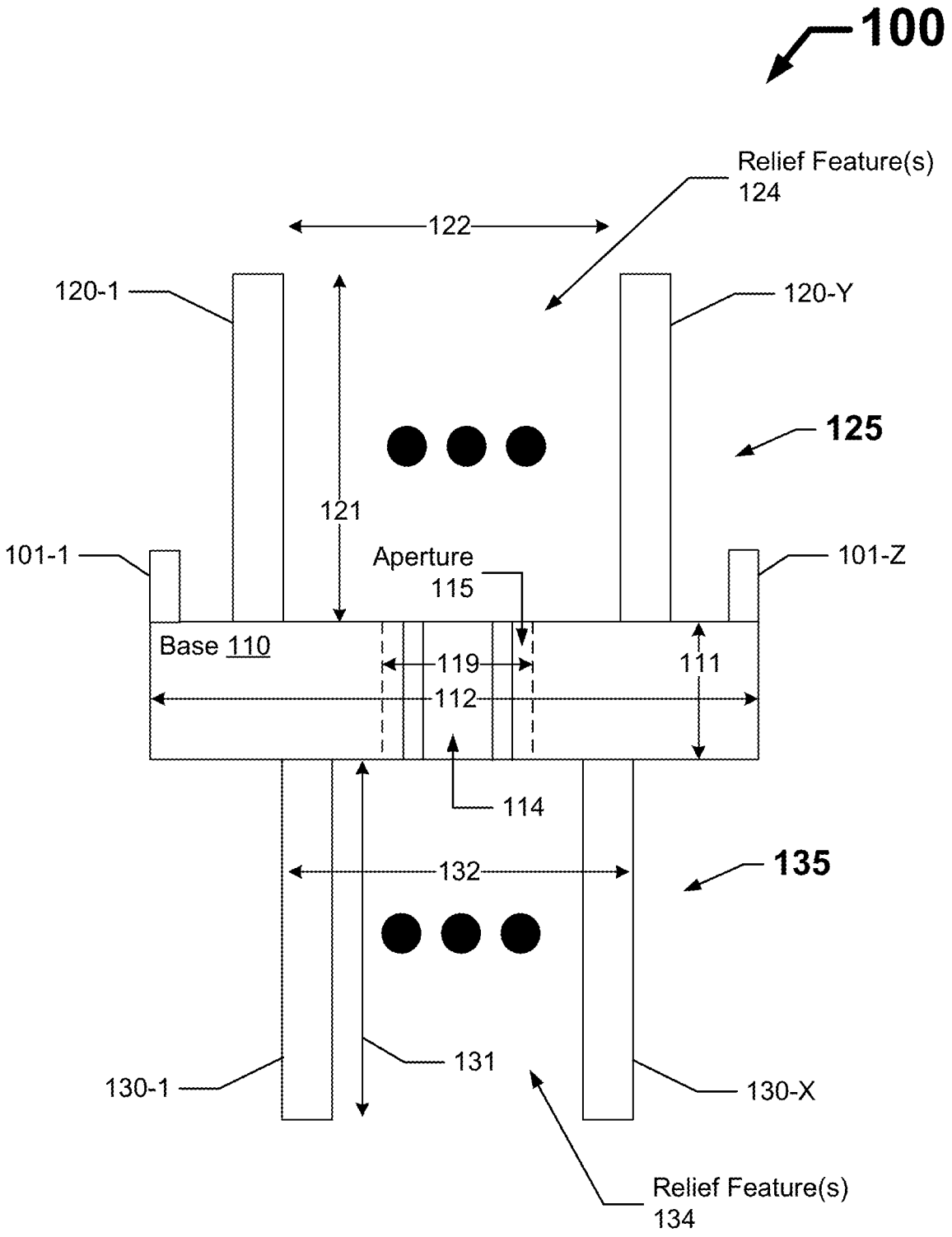
FIG. 1 shows a general system diagram of a casing running rotary insert according to certain example embodiments.

In general, example embodiments provide systems, methods, and devices for casing running rotary inserts. Example embodiments can provide a number of benefits. Such benefits can include, but are not limited to, minimal interruption time of an operation (e.g., tripping in casing), ease of installation and uninstallation, improved safety, improved efficiency, and compliance with industry standards that apply to wireline operations. Example embodiments described herein are directed for use in certain environments (e.g., hazardous, maritime, land-based) in which casing operations are conducted.

As defined herein, a user may be any person that is involved with a field operation that includes tripping in and/or tripping out a casing string and/or a tubing string. Examples of a user may include, but are not limited to, a drilling engineer, a roughneck, a company representative, a mechanic, an operator, an employee, a consultant, a contractor, and a manufacturer's representative. Example casing running rotary inserts can be made of one or more of a number of suitable materials to allow the casing running rotary inserts to meet certain standards and/or regulations while also maintaining durability in light of the one or more conditions under which the casing running rotary inserts may be exposed. Examples of such materials can include, but are not limited to, aluminum, stainless steel, galvanized steel, plastic (e.g., polytetrafluoroethylene (PTFE), nylon), and a polymer (e.g., an acetal homopolymer, a copolymer of terephthalic acid (1,4) and ethylene glycol).

Example casing running rotary inserts, or portions or components thereof, described herein can be made from a single piece (e.g., from a mold, using injection molding, using a die cast process, using a milling and/or lathing process, using an extrusion process, 3D printing). In addition, or in the alternative, example casing running rotary inserts (including portions or components thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, snap fittings, and slotted fittings. One or more pieces that are mechanically coupled to each other can be coupled to each other in one or more of a number of ways, including but not limited to fixed hinged, removable, sliding, rotatable e, and threaded.

The use of the terms "substantially", "about", "approximately", and similar terms apply to all numeric values, whether or not explicitly indicated. These terms generally refer to a range of numbers that one of ordinary skill in the art would consider as a reasonable amount of deviation to the recited numeric values (i.e., having the equivalent function or result). For example, this term may be construed as including a deviation of +10 percent of the given numeric value provided such a deviation does not alter the end function or result of the value. Therefore, an angle that is substantially perpendicular may be construed to be within a range from 81° to 99°. Furthermore, a range may be construed to include the start and the end of the range. For example, a range of 10% to 20% (i.e., range of 10%-20%) includes 10% and also includes 20%, and includes percentages in between 10% and 20%, unless explicitly stated otherwise herein. Similarly, a range of between 10% and 20% (i.e., range between 10%-20%) includes 10% and also includes 20%, and includes percentages in between 10% and 20%, unless explicitly stated otherwise herein.

A "subterranean formation" refers to practically any volume under a surface. For example, it may be practically any volume under a terrestrial surface (e.g., a land surface), practically any volume under a seafloor, etc. Each subsurface volume of interest may have a variety of characteristics, such as petrophysical rock properties, reservoir fluid properties, reservoir conditions, hydrocarbon properties, or any combination thereof. For example, each subsurface volume of interest may be associated with one or more of: temperature, porosity, salinity, permeability, water composition, mineralogy, hydrocarbon type, hydrocarbon quantity, reservoir location, pressure, etc. Those of ordinary skill in the art will appreciate that the characteristics are many, including, but not limited to: shale gas, shale oil, tight gas, tight oil, tight carbonate, carbonate, vuggy carbonate, unconventional (e.g., a permeability of less than 25 millidarcy (mD) such as a permeability of from 0.000001 mD to 25 mD)), diatomite, geothermal, mineral, etc. The terms "formation", "subsurface formation", "hydrocarbon-bearing formation", "reservoir", "subsurface reservoir", "subsurface area of interest", "subsurface region of interest", "subsurface volume of interest", and the like may be used synonymously. The term "subterranean formation" is not limited to any description or configuration described herein.

A "well" or a "wellbore" refers to a single hole, usually cylindrical, that is drilled into a subsurface volume of interest. A well or a wellbore may be drilled in one or more directions. For example, a well or a wellbore may include a vertical well, a horizontal well, a deviated well, and/or other type of well. A well or a wellbore may be drilled in the subterranean formation for exploration and/or recovery of resources. A plurality of wells (e.g., tens to hundreds of wells) or a plurality of wellbores are often used in a field depending on the desired outcome.

A well or a wellbore may be drilled into a subsurface volume of interest using practically any drilling technique and equipment known in the art, such as geo-steering, directional drilling, etc. Drilling the well may include using a tool, such as a drilling tool that includes a drill bit and a drill string. Drilling fluid, such as drilling mud, may be used while drilling in order to cool the drill tool and remove cuttings. Other tools may also be used while drilling or after drilling, such as measurement-while-drilling (MWD) tools, seismic-while-drilling tools, wireline tools, logging-while-drilling (LWD) tools, or other downhole tools. After drilling to a predetermined depth, the drill string and the drill bit may be removed, and then the casing, the tubing, and/or other equipment may be installed according to the design of the well. The equipment to be used in drilling the well may be dependent on the design of the well, the subterranean formation, the hydrocarbons, and/or other factors.

A well may include a plurality of components, such as, but not limited to, a casing, a liner, a tubing string, a sensor, a packer, a screen, a gravel pack, artificial lift equipment (e.g., an electric submersible pump (ESP)), and/or other components. If a well is drilled offshore, the well may include one or more of the previous components plus other offshore components, such as a riser. A well may also include equipment to control fluid flow into the well, control fluid flow out of the well, or any combination thereof. For example, a well may include a wellhead, a choke, a valve, and/or other control devices. These control devices may be located on the surface, in the subsurface (e.g., downhole in the well), or any combination thereof. In some embodiments, the same control devices may be used to control fluid flow into and out of the well.

In some embodiments, different control devices may be used to control fluid flow into and out of a well. In some embodiments, the rate of flow of fluids through the well may depend on the fluid handling capacities of the surface facility that is in fluidic communication with the well. The equipment to be used in controlling fluid flow into and out of a well may be dependent on the well, the subsurface region, the surface facility, and/or other factors. Moreover, sand control equipment and/or sand monitoring equipment may also be installed (e.g., downhole and/or on the surface). A well can on occasion use wireline services for wellbore evaluation ("logging"), equipment retrieval ("fishing"), conveyance of downhole tools, and the like. A well may also include any completion hardware that is not discussed separately. The term "well" may be used synonymously with the terms "borehole," "wellbore," or "well bore." The term "well" is not limited to any description or configuration described herein.

It is understood that when combinations, subsets, groups, etc. of elements are disclosed (e.g., combinations of components in a composition, or combinations of steps in a method), that while specific reference of each of the various individual and collective combinations and permutations of these elements may not be explicitly disclosed, each is specifically contemplated and described herein. By way of example, if an item is described herein as including a component of type A, a component of type B, a component of type C, or any combination thereof, it is understood that this phrase describes all of the various individual and collective combinations and permutations of these components. For example, in some embodiments, the item described by this phrase could include only a component of type A.

In some embodiments, the item described by this phrase could include only a component of type B. In some embodiments, the item described by this phrase could include only a component of type C. In some embodiments, the item described by this phrase could include a component of type A and a component of type B. In some embodiments, the item described by this phrase could include a component of type A and a component of type C. In some embodiments, the item described by this phrase could include a component of type B and a component of type C. In some embodiments, the item described by this phrase could include a component of type A, a component of type B, and a component of type C.

In some embodiments, the item described by this phrase could include two or more components of type A (e.g., A1 and A2). In some embodiments, the item described by this phrase could include two or more components of type B (e.g., B1 and B2). In some embodiments, the item described by this phrase could include two or more components of type C (e.g., C1 and C2). In some embodiments, the item described by this phrase could include two or more of a first component (e.g., two or more components of type A (A1 and A2)), optionally one or more of a second component (e.g., optionally one or more components of type B), and optionally one or more of a third component (e.g., optionally one or more components of type C).

In some embodiments, the item described by this phrase could include two or more of a first component (e.g., two or more components of type B (B1 and B2)), optionally one or more of a second component (e.g., optionally one or more components of type A), and optionally one or more of a third component (e.g., optionally one or more components of type C). In some embodiments, the item described by this phrase could include two or more of a first component (e.g., two or more components of type C (C1 and C2)), optionally one or more of a second component (e.g., optionally one or more components of type A), and optionally one or more of a third component (e.g., optionally one or more components of type B).

In the foregoing figures showing example embodiments of casing running rotary inserts, one or more of the components shown may be omitted, repeated, and/or substituted. Accordingly, example embodiments of casing running rotary inserts should not be considered limited to the specific arrangements of components shown in any of the figures. For example, features shown in one or more figures or described with respect to one embodiment can be applied to another embodiment associated with a different figure or description.

In certain example embodiments, systems using example casing running rotary inserts are subject to meeting certain standards and/or requirements. Examples of entities that set such standards and/or requirements can include, but are not limited to, the Society of Petroleum Engineers, the American Petroleum Institute (API), the International Standards Organization (ISO), the National Institute of Standards and Technology (NIST), and the Occupational Safety and Health Administration (OSHA). Use of example embodiments described herein meet (and/or allow the wireline systems to meet) such standards and/or requirements when applicable.

If a component of a figure is described but not expressly shown or labeled in that figure, the label used for a corresponding component in another figure can be inferred to that component. Conversely, if a component in a figure is labeled but not described with respect to that figure, the description for such component can be substantially the same as the description for a corresponding component in another figure. The numbering scheme for the various components in the figures herein is such that each component is a three-digit number or a four-digit number, and corresponding components in other figures have the identical last two digits.

In addition, a statement that a particular embodiment (e.g., as shown in a figure herein) does not have a particular feature or component does not mean, unless expressly stated, that such embodiment is not capable of having such a feature or component. For example, for purposes of present or future claims herein, a feature or component that is described as not being included in an example embodiment shown in one or more particular drawings is capable of being included in one or more claims that correspond to such one or more particular drawings herein.

Example embodiments of casing running rotary inserts will be described more fully hereinafter with reference to the accompanying drawings, in which example embodiments of casing running rotary inserts are shown. Casing running rotary inserts may, however, be embodied in many different forms and should not be construed as limited to the example embodiments set forth herein. Rather, these example embodiments are provided so that this disclosure will be thorough and complete, and will fully convey the scope of casing running rotary inserts to those of ordinary skill in the art. Like, but not necessarily the same, elements (also sometimes called components) in the various figures are denoted by like reference numerals for consistency.

Terms such as "first", "second", "above", "below", "inner", "outer", "distal", "proximal", "end", "top", "bottom", "upper", "lower", "side", "left", "right", "front", "rear", and "within", when present, are used merely to distinguish one component (or part of a component or state of a component) from another. Such terms are not meant to denote a preference or a particular orientation. Such terms are not meant to limit embodiments of casing running rotary inserts. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

FIG. 1 shows a general system diagram of a casing running rotary insert 100 according to certain example embodiments. The example casing running rotary insert 100 (also sometimes referred to herein as a casing bowl lock box) of FIG. 1 includes a base 110, a rotary table engagement feature 135 that extends from the bottom of the base 110, and a casing bowl engagement feature 125 that extends from the top of the base 110. The casing running rotary insert 100 may also include any number (e.g., one, two, four) of lifting mechanism receiving features 101 (e.g., pad eyes) that are configured to receive part (e.g., a cable) of a lifting mechanism (e.g., a crane) for moving the casing running rotary insert 100. In this case, there are Z lifting mechanism receiving features 101 (lifting mechanism receiving feature 101-1 through lifting mechanism receiving feature 101-Z).

The base 110 of the casing running rotary insert 100 includes an aperture 115 that traverses the thickness 111 of the base 110. The lengthwise axis of aperture 115 may be substantially coincident with the substantial center of the base 110. The aperture 115 may be cylindrical (may be circular in shape when viewed from above). Alternatively, the aperture 115 may have any of a number of other non-circular shapes (e.g., square, oval, clover-shaped, random) when viewed from above. The aperture 115 has a width 119, which may also be the same as or different than the length of aperture 115. The aperture 115 is designed to coincide with an aperture 248 in a rotary table 240 (discussed below with respect to FIGS. 2A and 2B) and an aperture 385 in a casing bowl 380 (discussed below with respect to FIGS. 3A and 3B).

The thickness 111 of the base 110 may be substantially uniform throughout, making the base 110 planar. In alternative embodiments, the thickness 111 of the base 110 may vary at multiple points along the base 110. When viewed from above, the base 110 may have any type of shape, including but not limited to square, rectangular, oval, circular, octagonal, and random. The base 110 has a width 112, which may also be the same as or different than a length of the base 110.

In some cases, the base 110 may include one or more optional relief features 114 (also sometimes called aperture relief features 114), each of which is configured to allow fluids (e.g., oil, working fluid, water) that flow up from a rotary table (e.g., rotary table 240), out of a casing string (e.g., casing string 790), and/or out of some other component of a system used to assemble or disassemble a casing string away from the casing running rotary insert 100. A relief feature 114 may additionally or alternatively provide mechanical stress relief as various forces are applied to the base 110 of the casing running rotary insert 100 during field operations (e.g., making up a tubing string, breaking out a tubing string). A relief feature 114 of the base 110 may have any of a number of configurations and/or features. For example, a relief feature 114 may be in the form of an opening that spans from the aperture 115 that traverses the thickness 111 of the base 110 to an outer perimeter of the base 110. As another example, a relief feature 114 of the base 110 may be in the form of a slope that starts at the aperture 115 and ends at or before the outer perimeter of the base 110.

The rotary table engagement feature 135 of the casing running rotary insert 100 extends from a bottom surface of the base 110. In certain example embodiments, the rotary table engagement feature 135 is configured to engage a complementary feature of a rotary table (e.g., rotary table 240 discussed below with respect to FIGS. 2A and 2B). When this occurs, the rotary table engagement feature 135 fixes the position of the base 110 (and the rest of the casing running rotary insert 100) relative to the rotary table. In some cases, the aperture 115 in the base 110 may be configured to align with a hole in the rotary table when the rotary table engagement feature 135 is engaged with the one or more complementary feature of the rotary table. In some cases, the rotary table engagement feature 135 is configured to have no overlap with the aperture 115 that traverses the thickness 111 of the base 110.

The rotary table engagement feature 135 of the casing running rotary insert 100 may have any of a number of components 130 (also referred to herein as rotary table engagement feature components 130). For example, the rotary table engagement feature 135 may include one or more components 130 in the form of walls or other types of protrusions that are positioned around some or all of the perimeter of the aperture 115 that traverses the thickness 111 of the base 110 along the bottom surface of the base 110. In this example, there may be X components 130 (component 130-1 through component 130-X) of the rotary table engagement feature 135. If a casing running rotary insert 100 has a rotary table engagement feature 135 with multiple components 130, the configuration (e.g., shape, size) of one component 130 of the rotary table engagement feature 135 may be the same as, or different than, the configuration of one or more of the other components 130 of the rotary table engagement feature 135. Collectively, the components 130 of the rotary table engagement feature 135 may have a height 131 and a width 132.

In some cases, the rotary table engagement feature 135 may include one or more optional relief features 134 (also sometimes called rotary table engagement relief features 134), each of which is configured to allow fluids (e.g., oil, working fluid, water) that flow up from a rotary table (e.g., rotary table 240), out of a casing string (e.g., casing string 790), and/or out of some other component of a system used to assemble or disassemble a casing string away from the casing running rotary insert 100. A relief feature 134 may additionally or alternatively provide mechanical stress relief as various forces are applied to the rotary table engagement feature 135 of the casing running rotary insert 100 during field operations (e.g., making up a tubing string, breaking out a tubing string). A relief feature 134 of the rotary table engagement feature 135 may have any of a number of configurations and/or features. For example, a relief feature 134 may be in the form of a break in continuity in the rotary table engagement feature 135 around the entire outer perimeter of the aperture 115 that traverses the thickness 111 of the base 110.

The casing bowl engagement feature 125 of the casing running rotary insert 100 extends from a top surface of the base 110. In certain example embodiments, the casing bowl engagement feature 125 is configured to engage a casing bowl (e.g., casing bowl 380 discussed below with respect to FIGS. 3A and 3B) to fix a position of the casing bowl relative to the base 110 of the casing running rotary insert 100. In some cases, the aperture 115 in the base 110 may be configured to align with an aperture in the casing bowl when the casing bowl engagement feature 125 is engaged with the casing bowl. In some cases, the casing bowl engagement feature 125 is configured to have no overlap with the aperture 115 that traverses the thickness 111 of the base 110.

The casing bowl engagement feature 125 of the casing running rotary insert 100 may have any of a number of components 120 (also referred to herein as casing bowl engagement feature components 120). For example, the casing bowl engagement feature 125 may include one or more components 120 in the form of walls or other types of protrusions that are positioned around some or all of the outer perimeter of the base 110 along the top surface of the base 110. In this example, there may be Y components 120 (component 120-1 through component 120-Y) of the casing bowl engagement feature 125. If a casing running rotary insert 100 has a casing bowl engagement feature 125 with multiple components 120, the configuration (e.g., shape, size) of one component 120 of the one casing bowl engagement feature 125 may be the same as, or different than, the configuration of one or more of the other components 120 of the casing bowl engagement feature 125. Collectively, the components 120 of the casing bowl engagement feature 125 may have a height 121 and a width 122.

In some cases, the casing bowl engagement feature 125 may include one or more optional relief features 124 (also sometimes called casing bowl engagement relief features 124), each of which is configured to allow fluids (e.g., oil, working fluid, water) that flow up from a rotary table (e.g., rotary table 240), out of a casing string (e.g., casing string 790), and/or out of some other component of a system used to assemble or disassemble a casing string away from the casing running rotary insert 100. A relief feature 124 may additionally or alternatively provide mechanical stress relief as various forces are applied to the casing bowl engagement feature 125 of the casing running rotary insert 100 during field operations (e.g., making up a tubing string, breaking out a tubing string). A relief feature 124 of the casing bowl engagement feature 125 may have any of a number of configurations and/or features. For example, a relief feature 124 may be in the form of a break in continuity in the casing bowl engagement feature 125 around the top surface of the entire outer perimeter of the base 110.

Figure 2A:
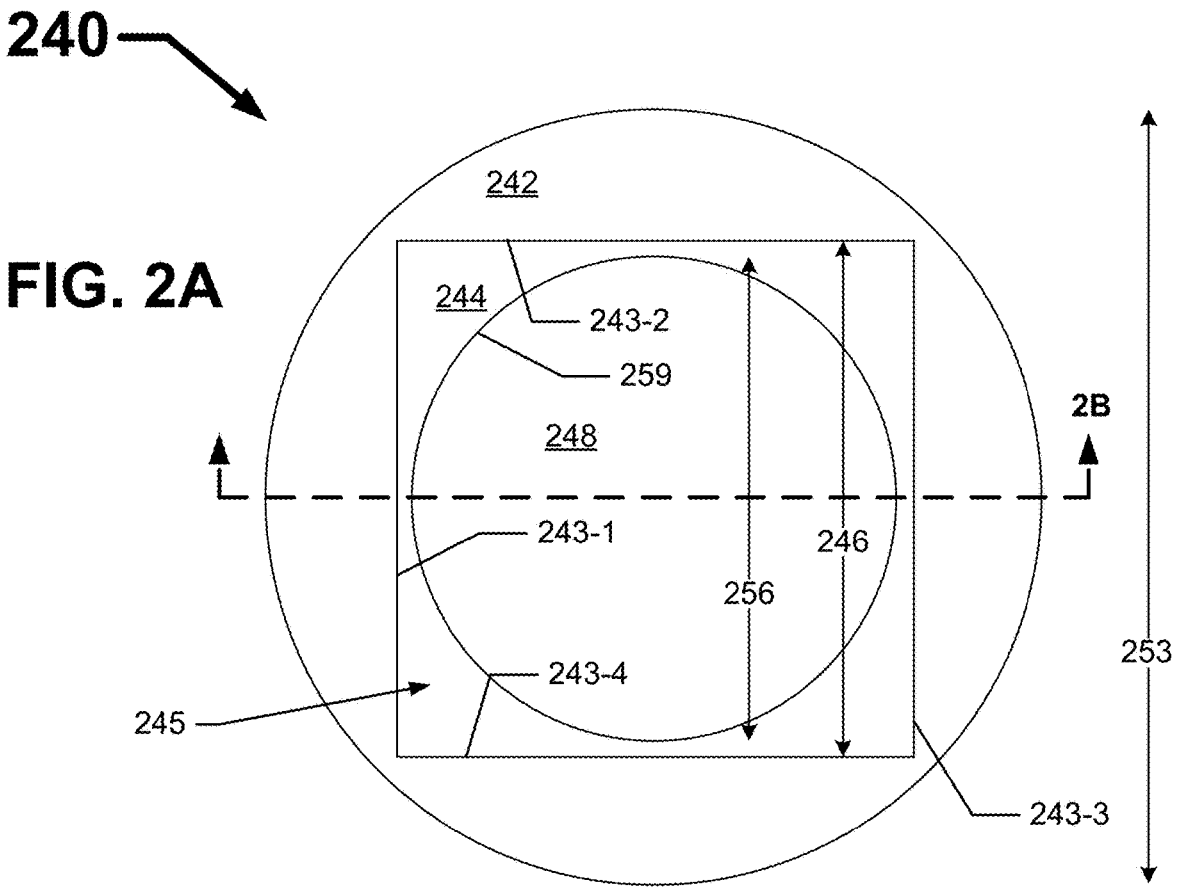
FIGS. 2A and 2B show various views of a rotary table with which example embodiments may be used.
Figure 2B:
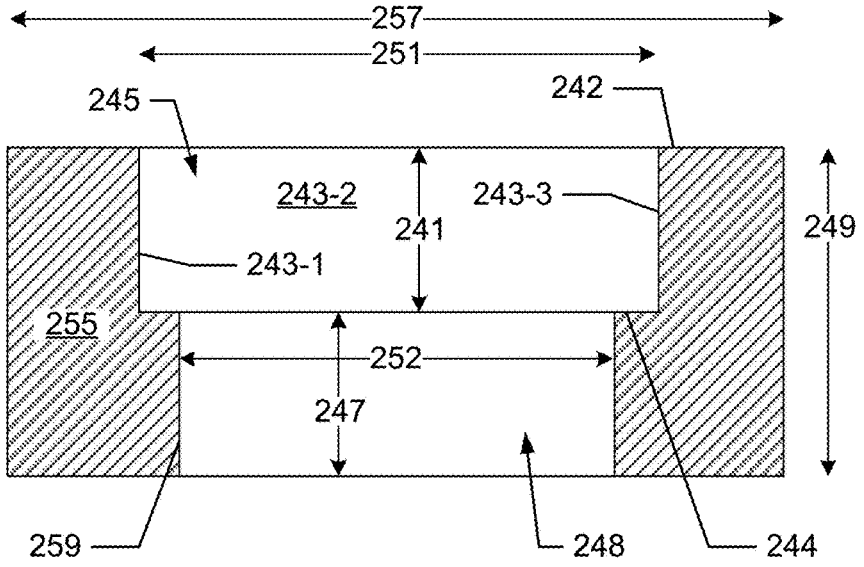

FIGS. 2A and 2B show various views of a rotary table 240 with which example embodiments may be used. Specifically, FIG. 2A shows a top view of the rotary table 240, and FIG. 2B shows a cross-sectional side view of the rotary table 240. Referring to the description above with respect to FIG. 1, the rotary table 240 of FIGS. 2A and 2B is configured to rotate and/or be held still (no rotation) using a mechanical drive (e.g., a motor and gear assembly), which is not shown here. The rotary table 240 has a body 255 defined by a top surface 242 and having a length 253, a width 257, and a height 249. The body 255 may be cylindrical (may be circular in shape when viewed from above), as in this case. Alternatively, the body 255 may have any of a number of other non-circular shapes (e.g., square, oval, clover-shaped, random) when viewed from above.

The rotary table 240 has an aperture 248 that traverses its height 249. The lengthwise axis of the aperture 248 may be substantially coincident with the substantial center of the body 255. The aperture 248 may be cylindrical (may be circular in shape when viewed from above), as in this case. Alternatively, the aperture 248 may have any of a number of other non-circular shapes (e.g., square, oval, clover-shaped, random) when viewed from above. The aperture 248 has a width 252, which may also be the same as or different than a length 256 of the aperture 248. The aperture 248 is defined by one or more walls 259.

Also disposed within the body 255 of the rotary table 240 is a recessed area 245 that is positioned vertically aligned with and atop the aperture 248. The recessed area 245 in this case is larger (when viewed from above) than the aperture 248. Because the aperture 248 and the recessed area 245 are concentric with respect to each other along the vertical axis, all of the aperture 248 is contained within the footprint of the recessed area 245 when viewed from above, as shown in FIG. 2A. The one or more parts of the recessed area 245 that are visible (that extend beyond the outer perimeter of the aperture 248) when viewed from above are defined by a bottom wall 244. The recessed area 245 has a height 241, and the aperture 248 (outside of the recessed area) has a height 247, where the height 241 and the height 247 are equal to the overall height 249 of the body 255 of the rotary table 240.

The recessed area 245 may have any of a number of shapes and/or sizes. In this case, the recessed area 245 is a three-dimensional rectangle having a length 246 (at least as great as the length 256 of the aperture 248), a width 251 (at least as great as the width 252 of the aperture 248), and the height 241. Other shapes of the recessed area 245 may include, but are not limited to, a three-dimensional octagon, a three-dimensional triangle, a three-dimensional pentagram, and a random three-dimensional shape.

The recessed area 245 may include one or more casing running rotary insert engagement features 243 that are configured to engage the rotary table engagement feature 135 (including its components 130) of the example casing running rotary insert 100. In this case, there are four casing running rotary insert engagement features 243 (casing running rotary insert engagement feature 243-1, casing running rotary insert engagement feature 243-2, casing running rotary insert engagement feature 243-3, and casing running rotary insert engagement feature 243-4) in the form of vertical walls that define the length 246 and the width 251 of the recessed area 245. A casing running rotary insert engagement feature 243 may have any of a number of other configurations, including but not limited to a protrusion, a slot, a detent, a tab, and a recess.

Figure 3A:
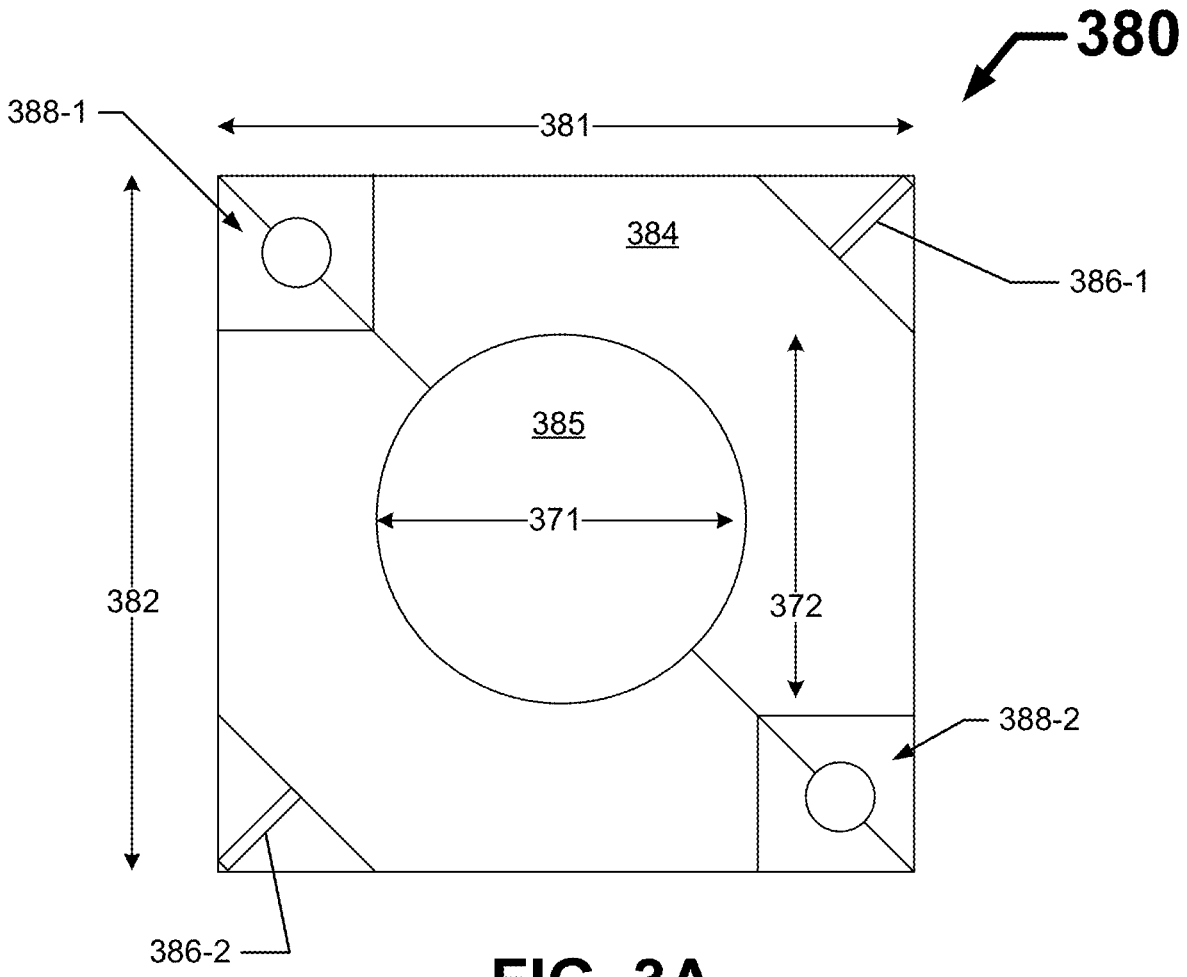
FIGS. 3A and 3B show various views of a casing bowl with which example embodiments may be used.
Figure 3B:
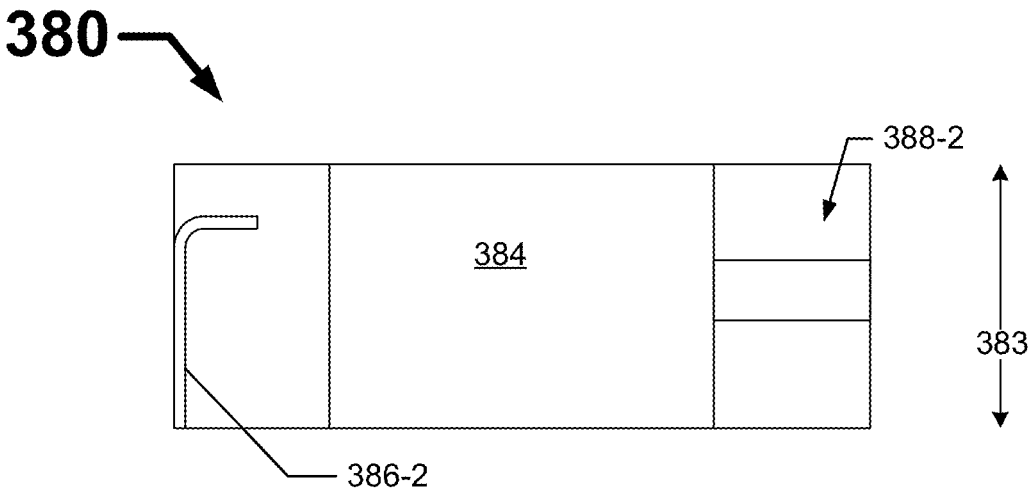

FIGS. 3A and 3B show various views of a casing bowl 380 with which example embodiments may be used. Specifically, FIG. 3A shows a top view of the casing bowl 380, and FIG. 3B shows a side view of the casing bowl 380. Referring to the description above with respect to FIGS. 1 through 2B, the casing bowl 380 of FIGS. 3A and 3B is configured to accommodate increasingly lengthening or shortening casing strings as casing stands (one or more (e.g., three) casing pipes) are added to or removed from the casing string. The casing bowl 380 has a body 384 having a length 382, a width 381, and a height 383. The body 384 may be a three-dimensional rectangle (e.g., may be square in shape when viewed from above), as in this case. Alternatively, the body 384 may have any of a number of other shapes (e.g., circular, oval, clover-shaped, random) when viewed from above.

The body 384 of the casing bowl 380 has an aperture 385 that traverses therethrough along its height 383. The aperture 385 is configured to receive casing pipes therein. In this case, the aperture 385 is cylindrical with the height 383 and a diameter equal to the length 372 and the width 371. The diameter of the aperture 385 is configured to be slightly larger than the outer diameter of the casing pipes of the casing string. In this way, one or more slips (e.g., the slips 702 of FIG. 7 below) may be inserted (wedged) into the aperture 385 of the casing bowl 380 around a tubing pipe of a tubing string to affix the tubing string relative to the casing bowl 380.

In some cases, the body 384 of the casing bowl 380 is made of multiple pieces that are coupled to each other using one or more coupling features 388. In this case, the body 384 is made of two pieces that are coupled to each other using two coupling features 388 (coupling feature 388-1 and coupling feature 388-2). The coupling features 388 may take any of a number of forms, including but not limited to hinges, bolts, and welds. The casing bowl 380 may be or include an insert bowl. The casing bowl 380 may also include any number (e.g., one, two, four) of lifting mechanism receiving features 386 (e.g., pad eyes) that are configured to receive part (e.g., a cable) of a lifting mechanism (e.g., a crane) for moving the casing bowl 380 relative to a casing running rotary insert (e.g., the casing running rotary insert 400 below). In this case, there are 2 lifting mechanism receiving features 386 (lifting mechanism receiving feature 386-1 and lifting mechanism receiving feature 386-2).

Figure 4A:
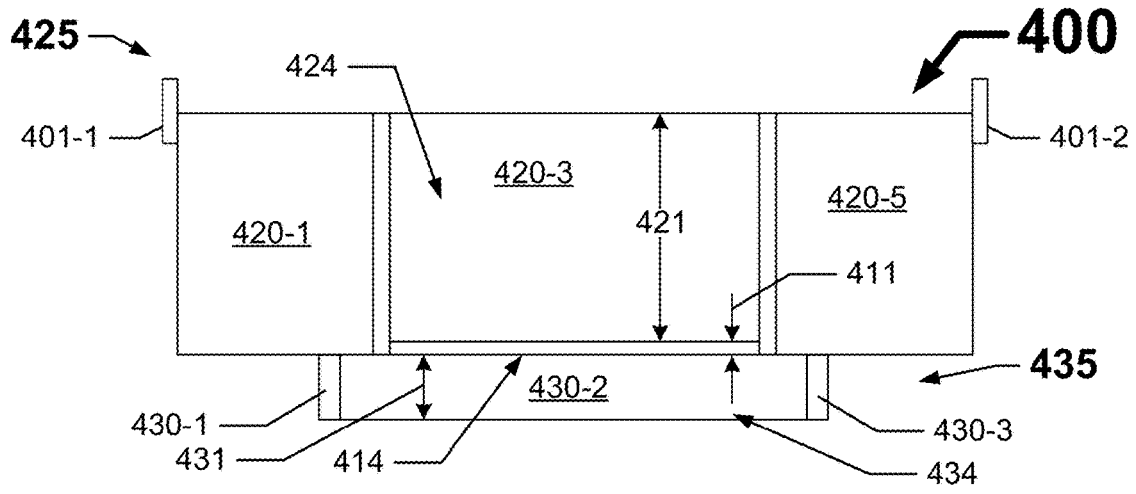
FIGS. 4A through 4C show various views of an example casing running rotary insert according to certain example embodiments.
Figure 4B:
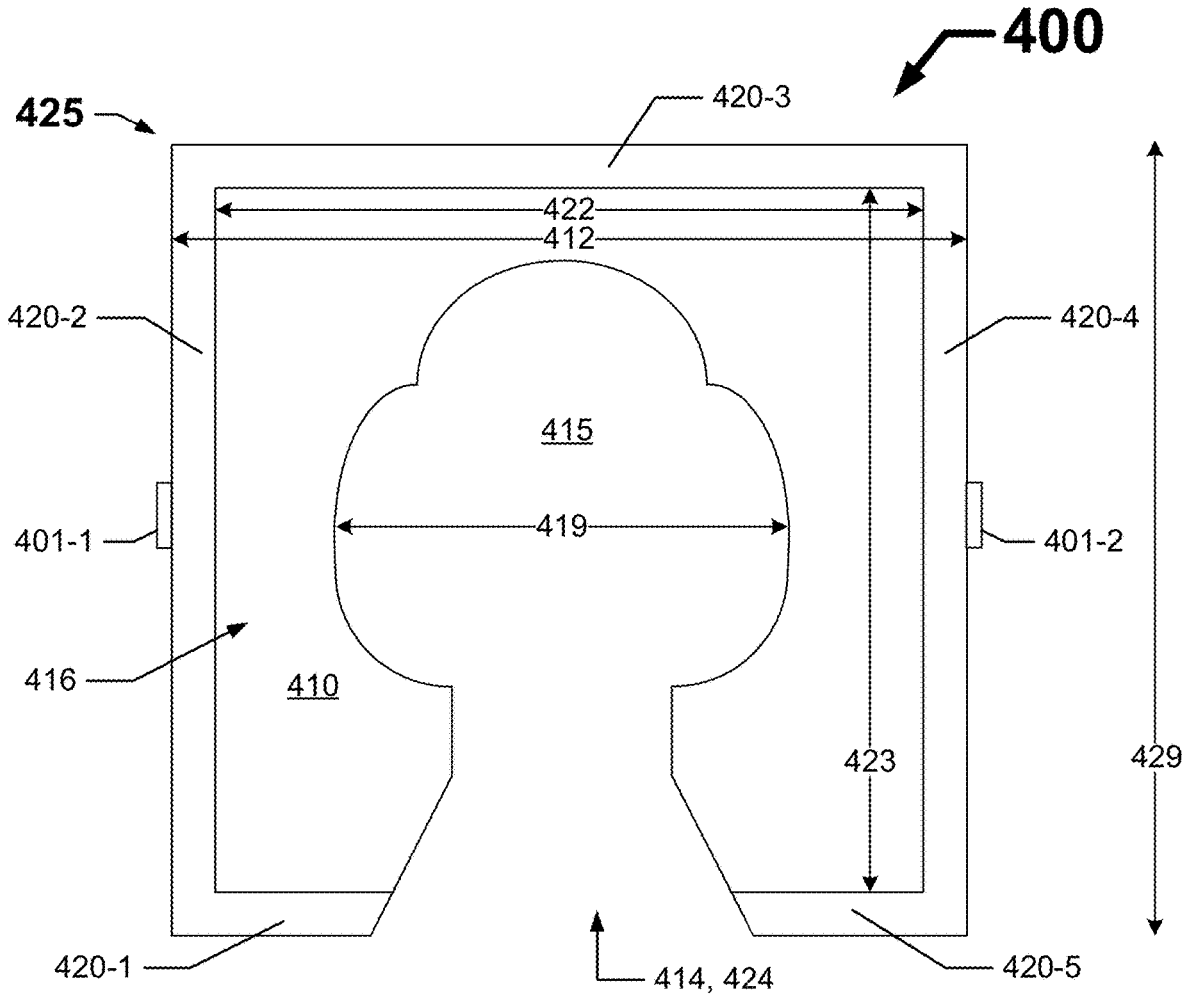
Figure 4C:
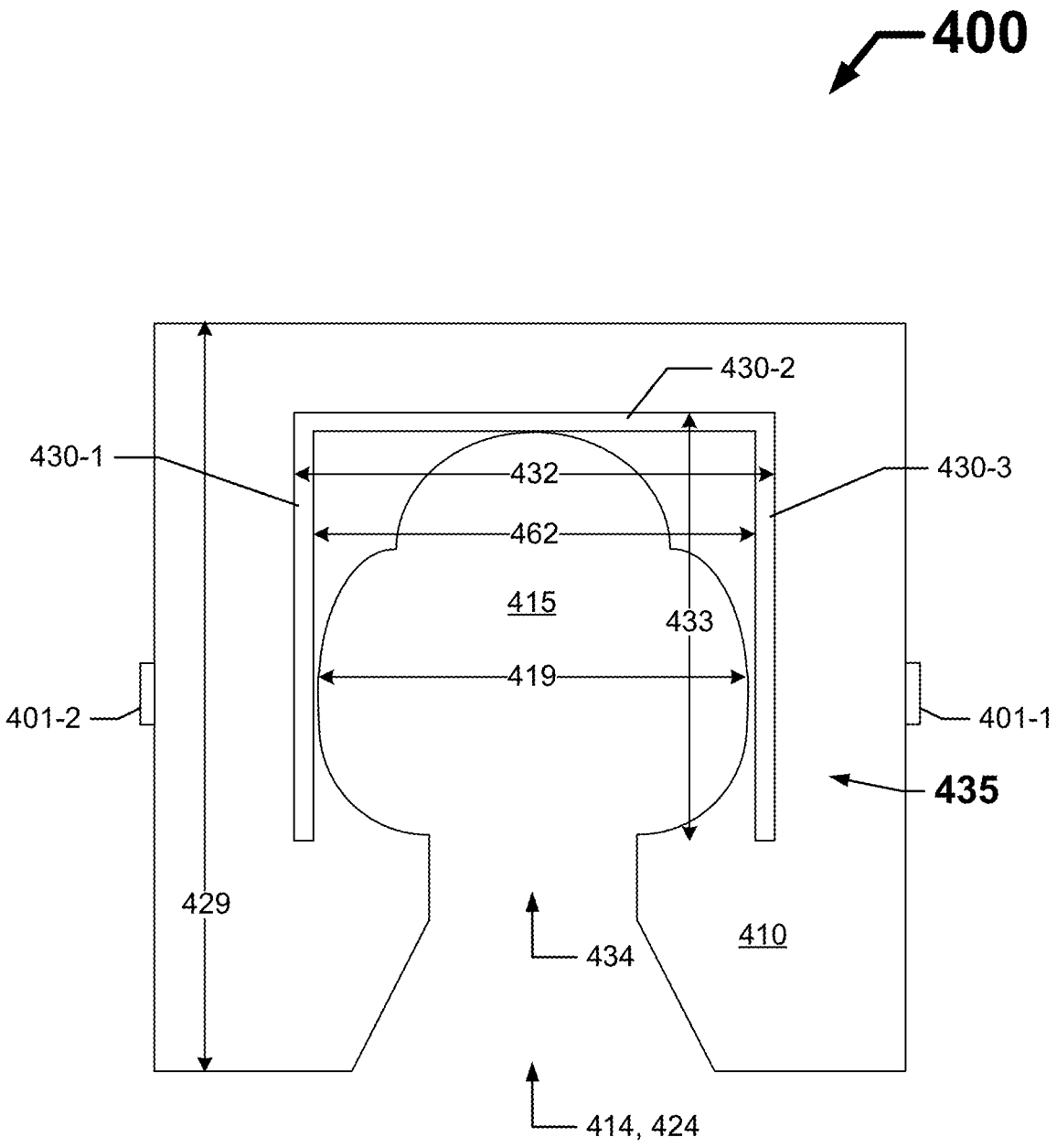

FIGS. 4A through 4C show various views of an example casing running rotary insert 400 according to certain example embodiments. Specifically, FIG. 4A shows a front view of the casing running rotary insert 400. FIG. 4B shows a top view of the casing running rotary insert 400. FIG. 4C shows a bottom view of the casing running rotary insert 400. Referring to the description above with respect to FIGS. 1 through 3B, the casing running rotary insert 400 of FIGS. 4A through 4C is an example of the casing running rotary insert 100 discussed above with respect to FIG. 1 and is designed to complement the rotary table 240 of FIGS. 2A and 2B and the casing bowl 380 of FIGS. 3A and 3B above.

For example, the casing running rotary insert 400 of FIGS. 4A through 4C includes a base 410, a rotary table engagement feature 435 that extends from the bottom of the base 410, and a casing bowl engagement feature 425 that extends from the top of the base 410. The casing running rotary insert 400 in this case also includes two lifting mechanism receiving features 401 (lifting mechanism receiving feature 401-1 and lifting mechanism receiving feature 401-2) that are configured to receive part (e.g., a cable) of a lifting mechanism (e.g., a crane) for moving the casing running rotary insert 400.

Figure 6A:
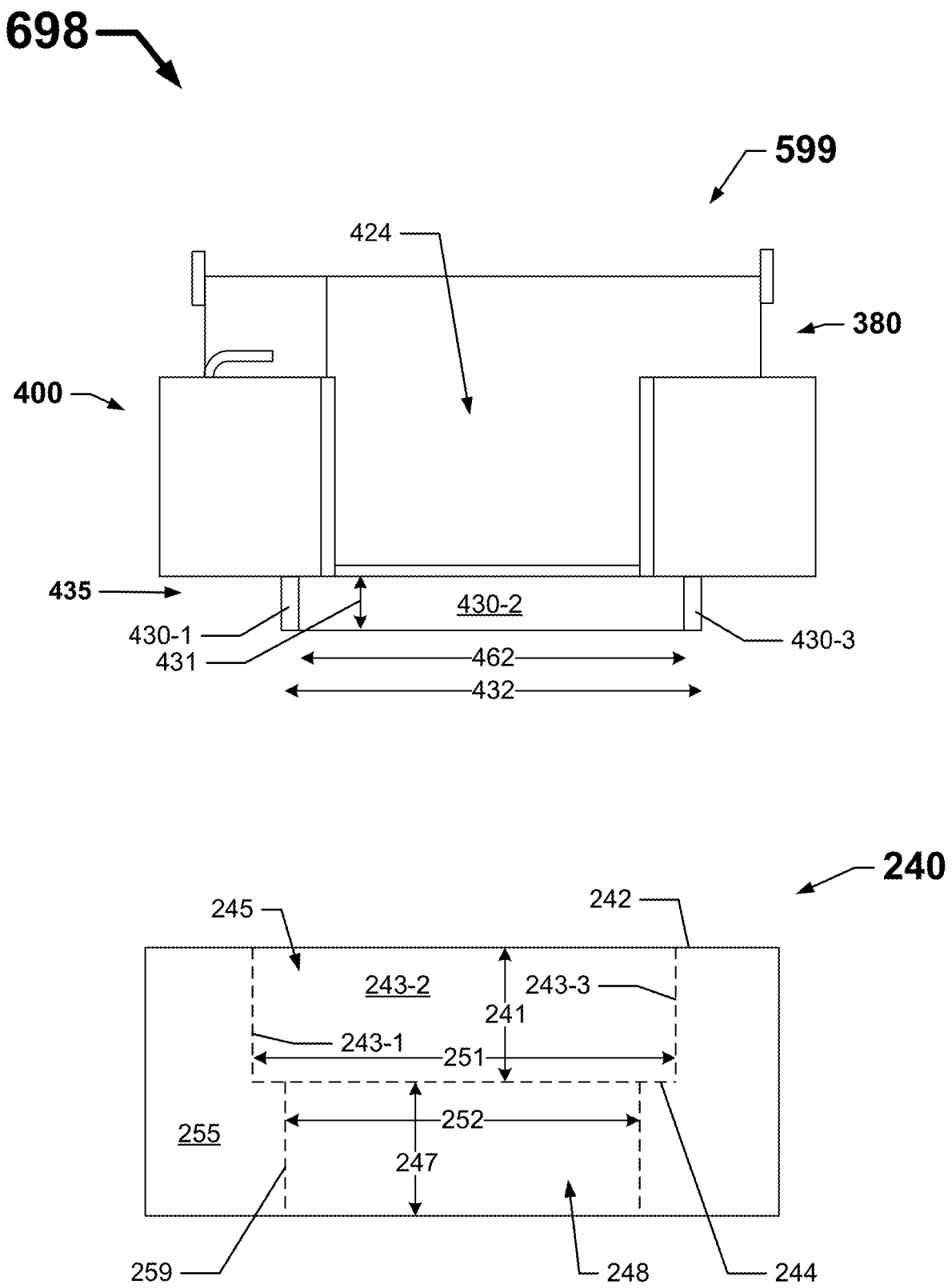
FIGS. 6A and 6B show various views of an assembly that includes the rotary table of FIGS. 2A and 2B and the subassembly of FIGS. 5A and 5B according to certain example embodiments.
Figure 6B:
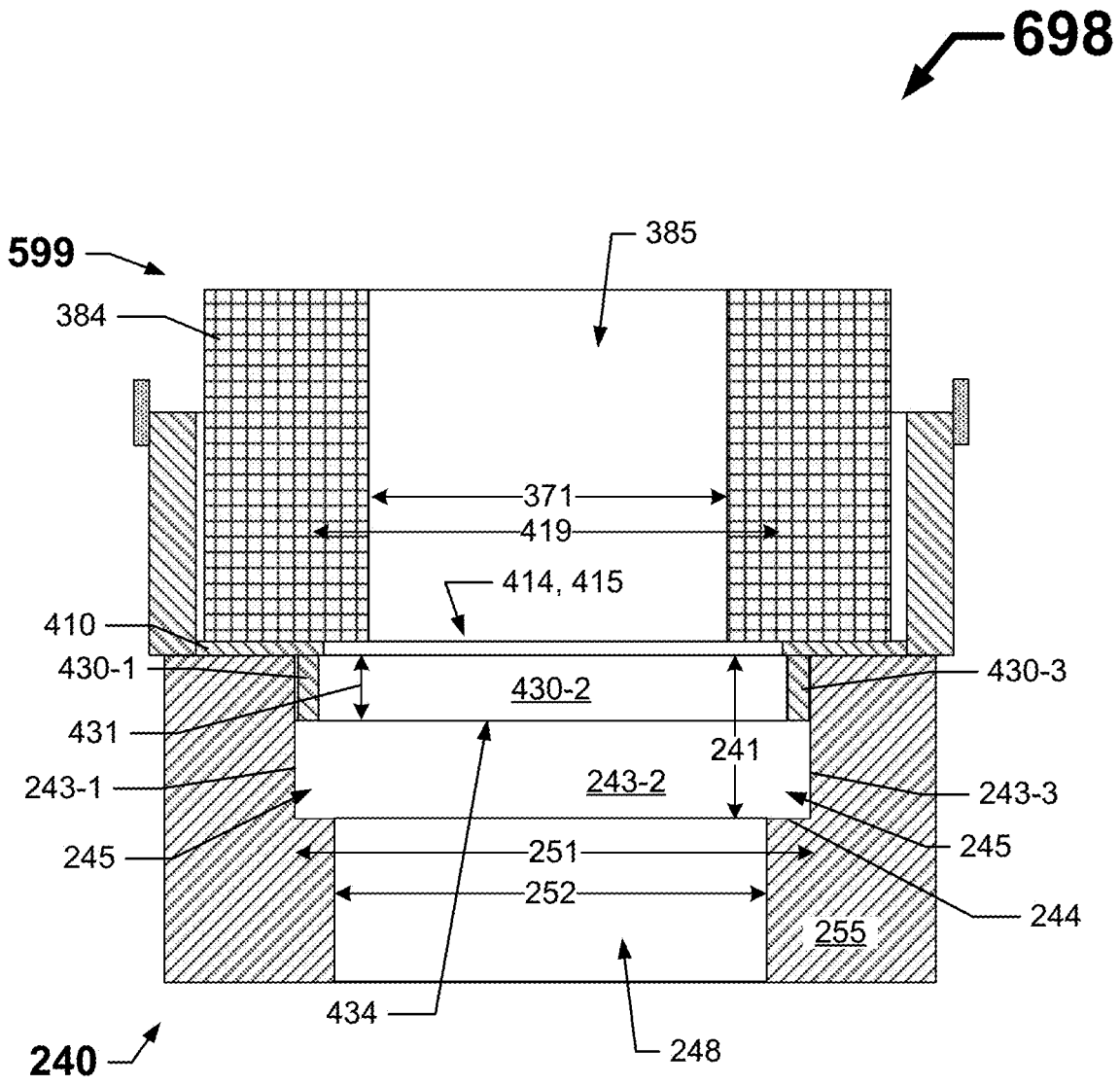

The base 410 of the casing running rotary insert 400 includes an aperture 415 that traverses the thickness 411 of the base 410. The lengthwise axis of aperture 415 in this case is substantially coincident with the substantial center of the base 410. The aperture 415 in this case is clover-shaped when viewed from above. The aperture 415 has a width 419, which may also be the same as or different than the length of the aperture 415. As shown in FIGS. 6A and 6B below, the aperture 415 is designed to coincide with the aperture 248 in a rotary table 240 and the aperture 385 in the casing bowl 380. The thickness 411 of the base 410 in this case is substantially uniform throughout, making the base 410 planar. When viewed from above, the base 410 in this case is substantially square such that the width 412 of the base is substantially the same as the length 429 of the base 410.

In this example, the base 410 includes one relief feature 414 (also sometimes called an aperture relief feature 414), which is configured to allow fluids (e.g., oil, working fluid, water) that flow up from a rotary table 240, out of a casing string (e.g., casing string 790), and/or out of some other component of a system used to assemble or disassemble a casing string away from the casing running rotary insert 400. A relief feature 414 may additionally or alternatively provide mechanical stress relief as various forces are applied to the base 410 of the casing running rotary insert 400 during field operations (e.g., making up a tubing string, breaking out a tubing string). In this case, the relief feature 414 is in the form of an opening that spans from the aperture 415 that traverses the thickness 411 of the base 410 to an outer perimeter of the base 410 at the front.

The rotary table engagement feature 435 of the casing running rotary insert 400 of FIGS. 4A through 4C extends from the bottom surface of the base 410. The rotary table engagement feature 435 is configured to engage (in this case, abut against) multiple casing running rotary insert engagement features 243 of the recessed area 245 of the rotary table 240. When this occurs, the rotary table engagement feature 435 fixes the position of the base 410 (and the rest of the casing running rotary insert 400) relative to the rotary table 240. As shown below with respect to FIGS. 6A through 7, the aperture 415 in the base 410 aligns with the aperture 248 in the rotary table 240 when the rotary table engagement feature 435 is engaged with the casing running rotary insert engagement features 243 of the recessed area 245 of the rotary table 240. In this example, the rotary table engagement feature 435 has no overlap with the aperture 415 that traverses the thickness 411 of the base 410.

In this case, the rotary table engagement feature 435 of the casing running rotary insert 400 has three components 430 (component 430-1, component 430-2, and component 430-3) that are in the form of walls that are positioned around three sides of the perimeter of the aperture 415 that traverses the thickness 411 of the base 410 along the bottom surface of the base 410. In this case, each of the three adjacent rotary table engagement feature components 430 has a height that is configured to be no greater than a height 241 of the casing running rotary insert engagement features 243 of the rotary table 240. The configuration (e.g., length, width, depth) of each component 430 of the rotary table engagement feature 435 are substantially the same as each other. In this example, the rotary table engagement feature 435 also includes a relief feature 434 (also sometimes called a rotary table engagement relief feature 434) in the form of an opening (a lack of a fourth wall or other barrier) between the distal ends of component 430-1 and component 430-3 along the bottom surface of the base 410 adjacent to the aperture 415 that traverses the thickness 411 of the base 410.

In this configuration of the rotary table engagement feature 435, component 430-1 and component 430-2 are coupled to each other to form substantially a right angle, and component 430-2 and component 430-3 are coupled to each other to form substantially a right angle. In this configuration, the components 430 of the rotary table engagement feature 435 has an open front side (opposite component 430-2, in the form of the relief feature 434), a width 462 (defined between the inner surfaces of component 430-1 and component 430-3), a length 433 (defined by the length of component 430-1 or component 430-3), and a height 431 (defined between the height 431 of each of the components 430 of the rotary table engagement feature 435). The width 462 is at least as great as the width 419 of the aperture 415 that traverses the base 410. The overall width 432 (defined between the outer surfaces of component 430-1 and component 430-3) of the rotary table engagement feature 435 in this case is less than the overall width 412 of the base 410, and the overall length 433 of the rotary table engagement feature 435 in this case is less than the overall length 429 of the base 410.

The casing bowl engagement feature 425 of the casing running rotary insert 400 extends from the top surface of the base 410. As discussed above, the casing bowl engagement feature 425 is configured to engage the casing bowl 380 in order to fix the position of the casing bowl 380 relative to the base 410 of the casing running rotary insert 400. The casing bowl engagement feature 425 is configured in such a way that the aperture 415 in the base 410 aligns with the aperture 385 in the casing bowl 380 when the casing bowl engagement feature 425 is engaged with the casing bowl 380. In this case, the casing bowl engagement feature 425 is also configured to have no overlap with the aperture 415 that traverses the thickness 411 of the base 410.

In this example, the casing bowl engagement feature 425 of the casing running rotary insert 400 has five components 420 (component 420-1, component 420-2, component 420-3, component 420-4, and component 420-5) that are in the form of walls positioned around most of the outer perimeter of the base 410 along the top surface of the base 410. The configuration (e.g., shape, size) of component 420-2, component 420-3, and component 420-4 are substantially the same as each other. Similarly, the configuration of component 420-1 and component 420-5 are substantially the same as each other and have a shorter length than the length of component 420-2, component 420-3, and component 420-4.

In this configuration of the casing bowl engagement feature 425, component 420-1 and component 420-2 are coupled to each other to form substantially a right angle, component 420-2 and component 420-3 are coupled to each other to form substantially a right angle, component 420-3 and component 420-4 are coupled to each other to form substantially a right angle, and component 420-4 and component 420-5 are coupled to each other to form substantially a right angle. In this configuration, the components 420 of the casing bowl engagement feature 425 form a cavity 416 having an open top end, a mostly open front side (in the form of a relief feature 424), a mostly open bottom (in the form of the aperture 415 in the base 410), a width 422 (defined between the inner surfaces of component 420-2 and component 420-4), a length 423 (defined between the inner surfaces of component 420-3 and either component 420-1 or component 420-5), and a height 421 (defined between the height 421 of each of the components 420 of the casing bowl engagement feature 425).

The overall width 412 (defined between the outer surfaces of component 420-2 and component 420-4) of the casing bowl engagement feature 425 in this case is the same as the overall width 412 of the base 410, and the overall length 429 (defined between the outer surfaces of component 420-3 and either component 420-1 or component 420-5) of the casing bowl engagement feature 425 in this case is the same as the overall length 429 of the base 410.

The casing bowl engagement feature 425 in this case includes a relief feature 424 (also sometimes called a casing bowl engagement relief feature 424) by virtue of the opening between component 420-1 and component 420-5 that traverses their height. The relief feature 424 of the casing bowl engagement feature 425 in this case is in the form of an opening that is coincident with the relief feature 414 of the base 410. Specifically, the relief feature 424 of the casing bowl engagement feature 425 coincides with the relief feature 414 of the base 410, which spans from the aperture 415 that traverses the base 410 to the outer perimeter of the base 410.

Figure 5A:
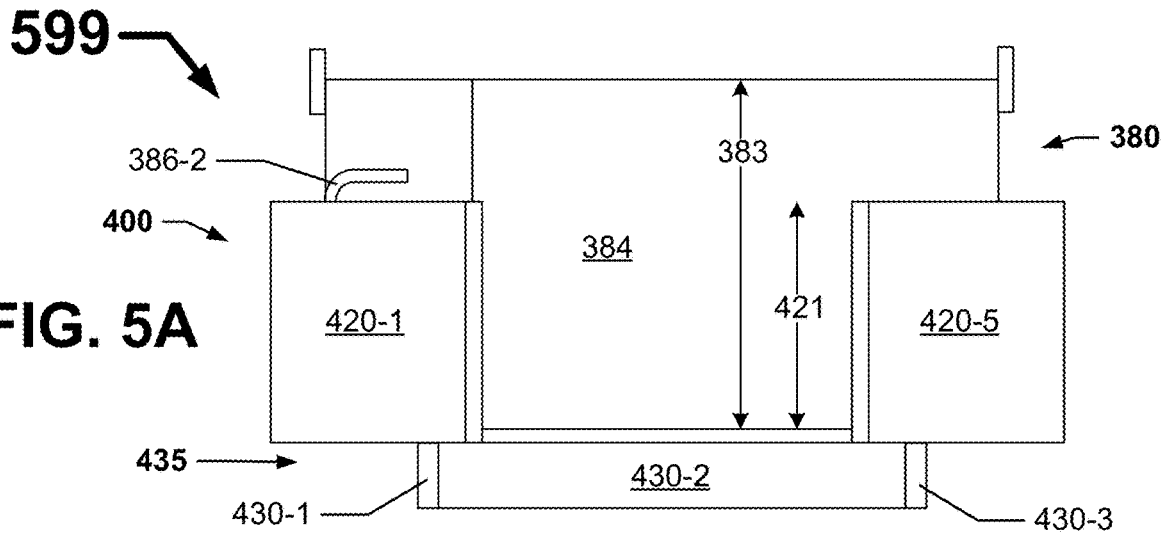
FIGS. 5A and 5B show a subassembly that includes the casing bowl of FIGS. 3A and 3B and the example casing running rotary insert of FIGS. 4A and 4B according to certain example embodiments.
Figure 5B:
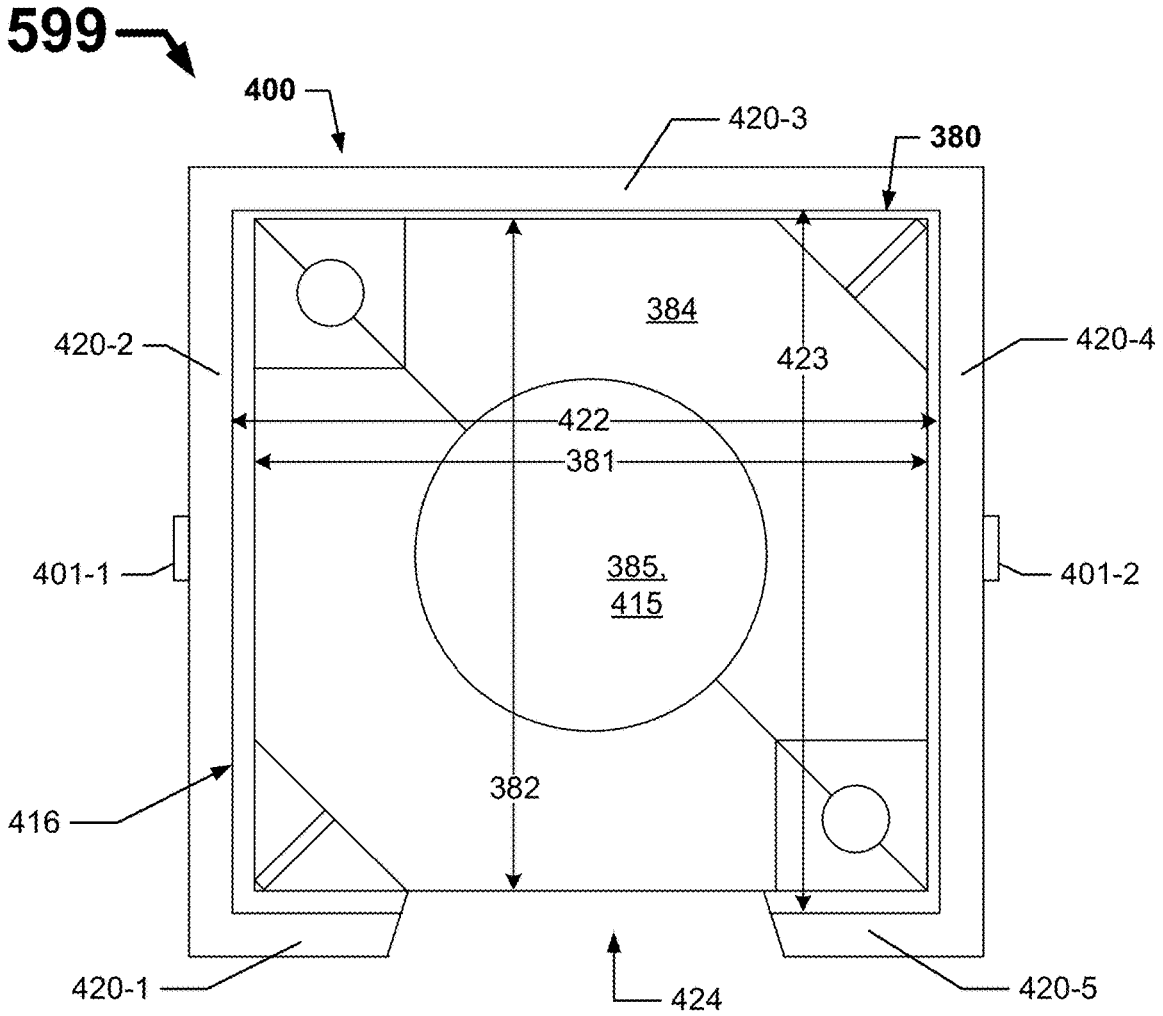

FIGS. 5A and 5B show subassembly 599 that includes the casing bowl 380 of FIGS. 3A and 3B and the example casing running rotary insert 400 of FIGS. 4A and 4B according to certain example embodiments. Specifically, FIG. 5A shows a front view of subassembly 599, and FIG. 5B shows a top view of subassembly 599. Referring to the description above with respect to FIGS. 1 through 4C, the subassembly 599 of FIGS. 5A and 5B shows the casing bowl 380 positioned within the cavity 416 formed by the components 420 of the casing bowl engagement feature 425 of the casing running rotary insert 400.

As discussed above, in this configuration of the casing bowl engagement feature 425, component 420-1 and component 420-2 are coupled to each other to form substantially a right angle, component 420-2 and component 420-3 are coupled to each other to form substantially a right angle, component 420-3 and component 420-4 are coupled to each other to form substantially a right angle, and component 420-4 and component 420-5 are coupled to each other to form substantially a right angle. In this way, the casing bowl engagement feature 425 surrounds most, but not all, of an outer perimeter of the casing bowl 380.

In this configuration, the components 420 of the casing bowl engagement feature 425 form the cavity 416 having an open top end through which the casing bowl 380 extends, a mostly open front side (in the form of the relief feature 424) that exposes most of a side of the body 384 of the casing bowl 380, a width 422 (defined by the inner surfaces of component 420-2 and component 420-4) that is at least as great as the width 381 of the casing bowl 380, a length 423 (defined by the inner surfaces of component 420-3 and either component 420-1 or component 420-5) that is at least as great as the length 382 of the casing bowl 380, and a height 421 (defined by the height 421 of each of the components 420 of the casing bowl engagement feature 425) that is in this case is less than the height 383 of the casing bowl 380. In alternative embodiments, the height 421 of the casing bowl engagement feature 425 may be the same as or greater than the height 383 of the casing bowl 380.

The subassembly 599 of FIGS. 5A and 5B shows that the rotary table engagement feature 435, including its components 430 (component 430-1, component 430-2, and component 430-3), have no direct interaction with the casing bowl 380 when the casing bowl 380 is engaged with the casing bowl engagement feature 425 of the casing running rotary insert 400. Also, when viewed from above, as in FIG. 5B, the base 410 of the casing running rotary insert 400 is obscured by the body 384 of the casing bowl 380. In other words, the size of the aperture 415 that traverses the base 410 of the casing running rotary insert 400 is larger than the size of the aperture 385 that traverses the body 384 of the casing bowl 380 when the casing bowl 380 is engaged with the casing bowl engagement feature 425 of the casing running rotary insert 400.

The lifting mechanism receiving features 386 (e.g., lifting mechanism receiving feature 386-2) of the casing bowl 380 in this case are located high enough on the body 384 of the casing bowl 380 that the lifting mechanism receiving features 386 are accessible (e.g., a cable from a crane or other lifting mechanism can be connected to and/or disconnected from the lifting mechanism receiving features 386) when the casing bowl 380 is engaged with (disposed within the cavity 416 of) the casing bowl engagement feature 425 of the casing running rotary insert 400.

FIGS. 6A and 6B show various views of assembly 698 that includes the rotary table 240 of FIGS. 2A and 2B and the subassembly 599 of FIGS. 5A and 5B according to certain example embodiments. Specifically, FIG. 6A shows an exploded side view of assembly 698, and FIG. 6B shows a cross-sectional front view of assembly 698. Referring to the description above with respect to FIGS. 1 through 5B, the assembly 698 of FIGS. 6A and 6B show that the rotary table engagement feature 435 of the casing running rotary insert 400 of the subassembly 599 is engaged with the casing running rotary insert engagement features 243 within the recessed area 245 of the rotary table 240 of FIGS. 2A and 2B.

Specifically, component 430-1 of the rotary table engagement feature 435 of the casing running rotary insert 400 abuts against casing running rotary insert engagement feature 243-1, component 430-2 of the rotary table engagement feature 435 of the casing running rotary insert 400 abuts against casing running rotary insert engagement feature 243-2, and component 430-3 of the rotary table engagement feature 435 of the casing running rotary insert 400 abuts against casing running rotary insert engagement feature 243-3.

In this case, the width 432 defined between the outer surfaces of the component 430-1 and component 430-3 of the rotary table engagement feature 435 of the casing running rotary insert 400 is slightly less than the width 251 defined between the inner surface of the casing running rotary insert engagement feature 243-1 and the inner surface of the casing running rotary insert engagement feature 243-3 of the recessed area 245 of the rotary table 240. Similarly, the length (i.e., length 246 from FIG. 2A above) of the recessed area 245 of the rotary table 240, defined between the inner surface of the casing running rotary insert engagement feature 243-2 and the inner surface of the casing running rotary insert engagement feature 243-4 of the recessed area 245 of the rotary table 240, is slightly larger than the length (i.e., length 433 of FIG. 4C above) of component 430-1 or component 430-3 of the rotary table engagement feature 435 of the casing running rotary insert 400.

The height 431 of the component 430-1, the component 430-2, and the component 430-3 of the rotary table engagement feature 435 of the casing running rotary insert 400 in this case is less than the height 241 of the casing running rotary insert engagement feature 243-1, the casing running rotary insert engagement feature 243-2, the inner surface of the casing running rotary insert engagement feature 243-3, and the casing running rotary insert engagement feature 243-4 of the recessed area 245 of the rotary table 240.

When the rotary table engagement feature 435 of the casing running rotary insert 400 is engaged with the casing running rotary insert engagement features 243 within the recessed area 245 of the rotary table 240, and when the casing bowl 380 is engaged with the casing bowl engagement feature 425 of the casing running rotary insert 400, as shown in FIG. 6B, there is a continuous aperture through the assembly 698. Specifically, the aperture 385 that traverses the height of the body 384 of the casing bowl 380 mergers with the aperture 415 that traverses the base 410 of the casing running rotary insert 400, which merges with the recessed area 245 and the aperture 248 that traverses the body 255 of the rotary table 240.

In this case, the width 371 (e.g., diameter) of the aperture 385 of the casing bowl 380 may be substantially the same as, or different than, the width 419 of the aperture 415 in the base 410, which may be substantially the same as, or different than, the width 251 of the recessed area 245 of the rotary table 240, which may be substantially the same as, or different than, the width 252 of the aperture 248 that traverses the body 255 of the rotary table 240. Similarly, the various fluid relief features of the assembly 698 are aligned with each other. Specifically, the relief feature 424 of the casing bowl engagement feature 425 coincides with the relief feature 414 of the base 410, which spans from the aperture 415 that traverses the base 410 to the outer perimeter of the base 410, and which coincides with the relief feature 434 of the rotary table engagement feature 435.

Figure 7:
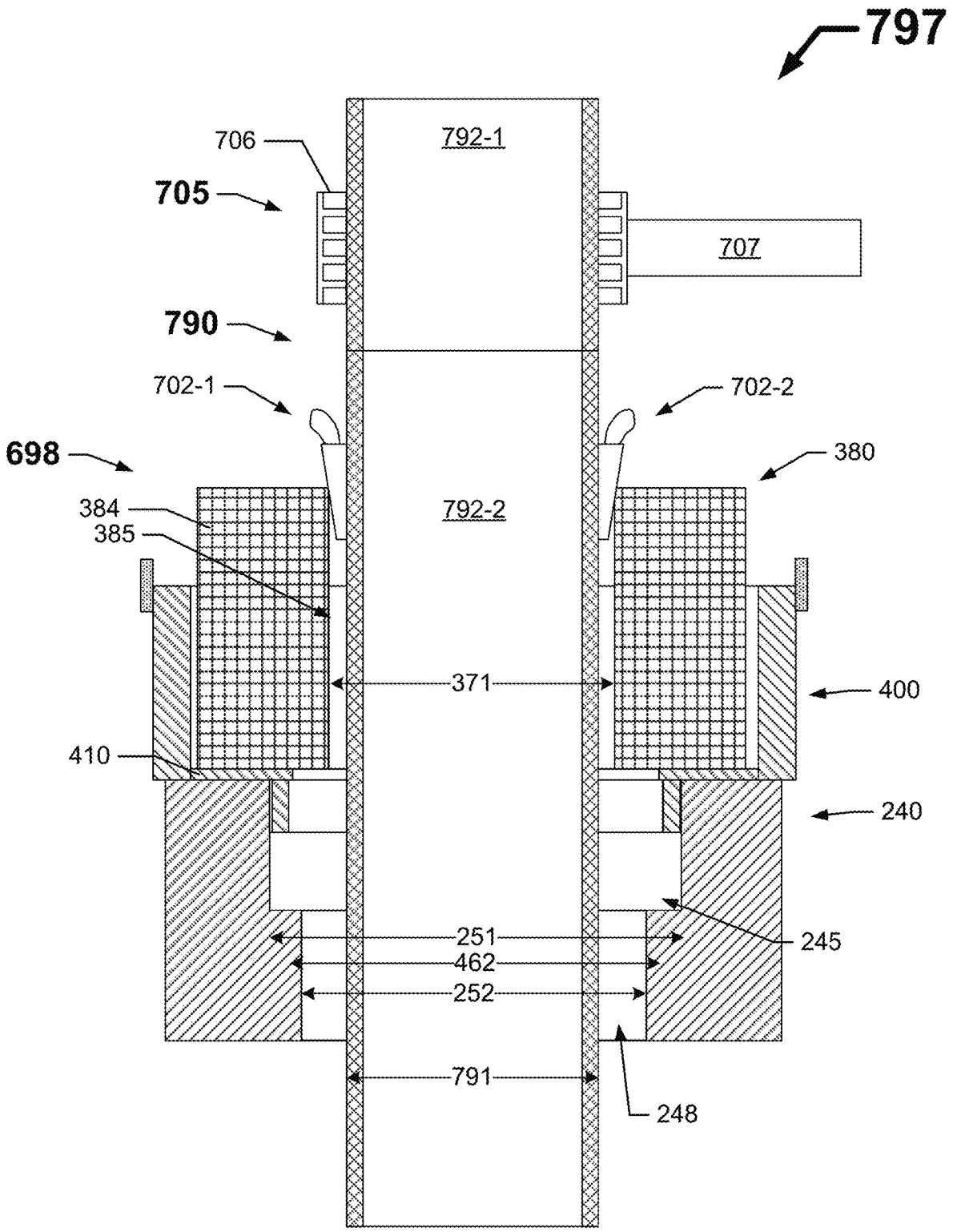
FIG. 7 shows a cross-sectional view of a system that includes the assembly of FIGS. 6A and 6B according to certain example embodiments.

FIG. 7 shows a cross-sectional view of system 797 that includes the assembly 698 of FIGS. 6A and 6B according to certain example embodiments. Referring to the description above with respect to FIGS. 1 through 6B, the system 797 of FIG. 7 includes a tubing string 790, one or more slips 702, and a tong assembly 705 in addition to the assembly 698 of FIGS. 6A and 6B. The tubing string 790 includes multiple tubing pipes 792 (tubing pipe 792-1, tubing pipe 792-2) that are directly or indirectly (e.g., using subs) threaded and coupled to each other.

In order for the tubing string 790 to be assembled (also called makeup) or disassembled (also called breakout), a lower end (in this case, the portion that includes tubing pipe 792-2 with multiple (e.g., hundreds, thousands) of other tubing pipes 792 coupled below the pipe 792-2) of the tubing string 790 is held stationary while the upper end (in this case, the portion that includes tubing pipe 792-1 and may be part of a pipe stand (e.g., a smaller assembly of 3 pipes 792)) of the tubing string 790 is rotated in the appropriate direction using the tong assembly 705. The tong assembly 705 includes a tong 706 and a support arm 707 that allows a user (e.g., a roughneck) to move the tong 706 into the proper position relative to a tubing pipe 792 at the upper end of the tubing string 790.

The pipes 792 of the tubing string 790 have a width 791 (in this case, an outer diameter) that is less than the width 371 of the aperture 385 that traverses the height 383 of the body 384 of the casing bowl 380, less than the width 462 of the rotary table engagement feature 435, less than the width 251 of the recessed area 245 of the rotary table 240, and less than the width 252 of the aperture 248 in a rotary table 240.

To prevent the tubing pipe 792-2 and the rest of the tubing string 790 that is coupled to the bottom end of the tubing pipe 792-2 from falling into the wellbore (below the aperture 248 in the rotary table 240), the one or more slips 702 (slip 702-1, slip 702-2) are inserted into the gap between the outer perimeter of the tubing pipe 792-2 and the inner perimeter of the aperture 385 of the casing bowl 380 as the tubing pipe 792-2 (and the rest of the tubing string 790) is lowered (e.g., using a pipe crane, using a Kelly).

When the tong 706 has finished its work (e.g., coupling the tubing pipe 792-1 to the tubing pipe 792-2 to elongate the tubing string 790, decoupling the tubing pipe 792-1 from the tubing pipe 792-2 to shorten the tubing string 790) with respect to the tubing pipe 792-1, the resulting tubing string 790 is lifted upward slightly (e.g., using the same equipment as discussed above to lower the tubing string 790) so that the slips 702 can be removed, allowing the tubing string 790 to be lowered (in the case of adding another tubing pipe 792 or stand of tubing pipes 792 to the tubing string 790) or raised further (in the case of removing the tubing pipe 792-2 or stand that includes the tubing pipe 792-2 from the tubing string 790).

Figure 8A:
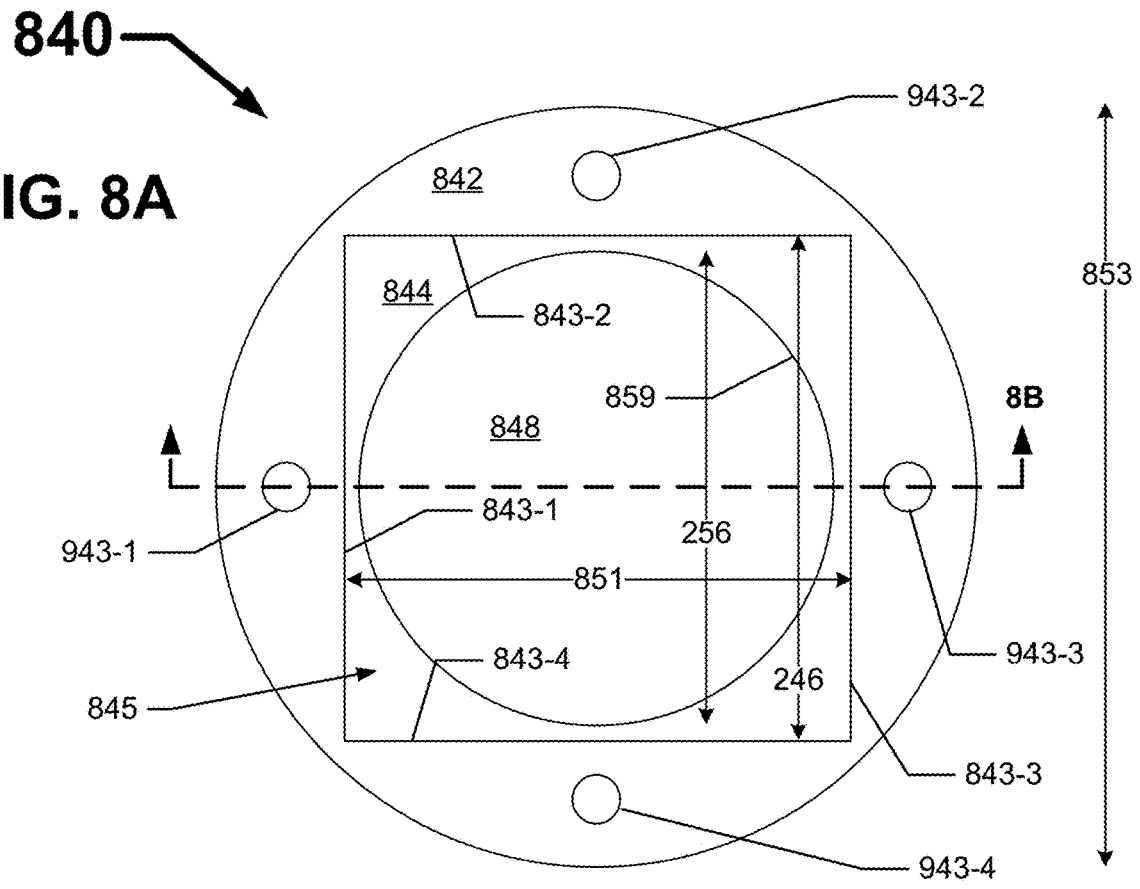
FIGS. 8A and 8B show an alternative rotary table with which example embodiments may be used.
Figure 8B:
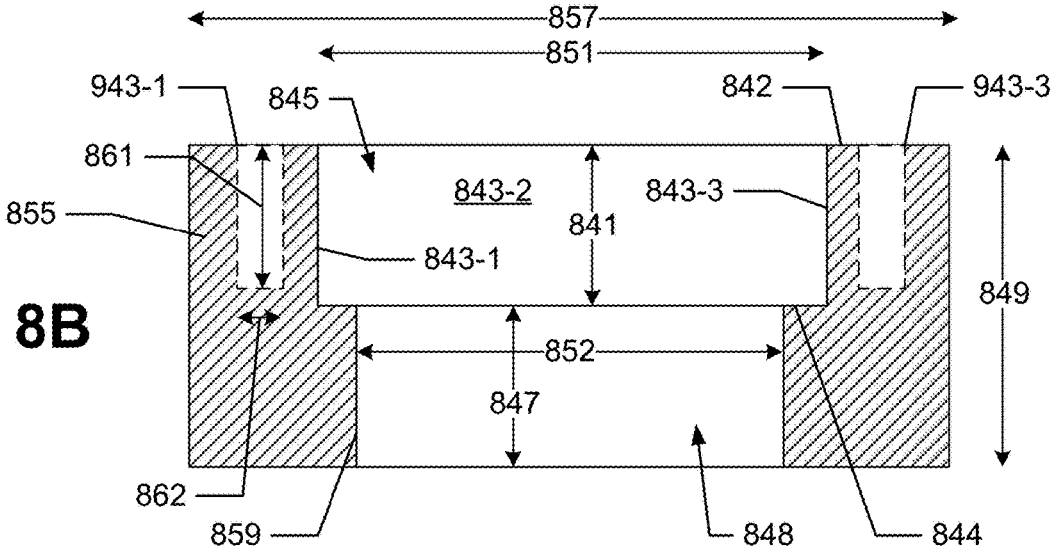

FIGS. 8A and 8B show an alternative rotary table 840 with which example embodiments may be used. Specifically, FIG. 8A shows a top view of the rotary table 840, and FIG. 8B shows a cross-sectional side view of the rotary table 840. Referring to the description above with respect to FIGS. 1 through 7, the rotary table 840 of FIGS. 8A and 8B may be substantially the same as the rotary table 240 discussed above with respect to FIGS. 2A and 2B, except as described below. For example, the rotary table 840 of FIGS. 8A and 8B is configured to rotate and/or be held still (no rotation) using a mechanical drive (e.g., a motor and gear assembly), which is not shown here. The rotary table 840 has a body 855 defined by a top surface 842 and having a length 853, a width 857, and a height 849. The body 855 is cylindrical (circular in shape when viewed from above) in this case.

The rotary table 840 has an aperture 848 that traverses its height 849. The lengthwise axis of the aperture 848 may be substantially coincident with the substantial center of the body 855. The aperture 848 is circular in shape when viewed from above in this case. The aperture 848 has a width 852, which may also be the same as or different than a length 856 of the aperture 848. The aperture 848 is defined by one or more walls 859.

Also disposed within the body 855 of the rotary table 840 is a recessed area 845 that is positioned vertically aligned with and atop the aperture 848. The recessed area 845 in this case is larger (when viewed from above) than the aperture 848. Because the aperture 848 and the recessed area 845 are concentric with respect to each other along the vertical axis, all of the aperture 848 is contained within the footprint of the recessed area 845 when viewed from above, as shown in FIG. 8A. The one or more parts of the recessed area 845 that are visible (that extend beyond the outer perimeter of the aperture 848) when viewed from above are defined by a bottom wall 844. The recessed area 845 has a height 841, and the aperture 848 (outside of the recessed area) has a height 847, where the height 841 and the height 847 are equal to the overall height 849 of the body 855 of the rotary table 840. In this case, the recessed area 845 is a three-dimensional rectangle having a length 846 (at least as great as the length 856 of the aperture 848), a width 851 (at least as great as the width 852 of the aperture 848), and the height 841.

The rotary table 840 in this case has two types of casing running rotary insert engagement features. The first set of casing running rotary insert engagement features of the rotary table 840 is integrated with the recessed area 845, as with the rotary table 240 of FIGS. 2A and 2B. In this case, the first set has four casing running rotary insert engagement features 843 (casing running rotary insert engagement feature 843-1, casing running rotary insert engagement feature 843-2, casing running rotary insert engagement feature 843-3, and casing running rotary insert engagement feature 843-4) in the form of vertical walls that define the length 846 and the width 851 of the recessed area 845.

The second set of casing running rotary insert engagement features of the rotary table 840 are integrated with the body 855 of the rotary table 840 at the top surface 842. In this case, the second set has four casing running rotary insert engagement features 943 (casing running rotary insert engagement feature 943-1, casing running rotary insert engagement feature 943-2, casing running rotary insert engagement feature 943-3, and casing running rotary insert engagement feature 943-4) in the form of holes that traverse into some, but not all, of the body 855 of the rotary table 840 from the top surface 842 between the recessed area 845 and the outer perimeter of the body 855. Casing running rotary insert engagement feature 943-4 in this case may be optional.

In alternative embodiments, there may be any other number (e.g., one, two, six, nine) of casing running rotary insert engagement features 943. In this case, the configuration (e.g., length, width, cross-sectional shape) of the four casing running rotary insert engagement features 943 is the same. In alternative embodiments, the configuration of one casing running rotary insert engagement feature 943 may be different than the configuration of one or more of the other casing running rotary insert engagement features 943. Each casing running rotary insert engagement feature 943 in this case is cylindrical bore having a width 862 and a depth 861. In alternative embodiments, any of the various characteristics (e.g., cross-sectional shape, depth, width) of one or more of the casing running rotary insert engagement features 943 may vary. For example, one or more of the casing running rotary insert engagement features 943 may have a cross-sectional shape of an oval, a square, a rectangle, a pentagon, and an octagon.

Figure 9A:
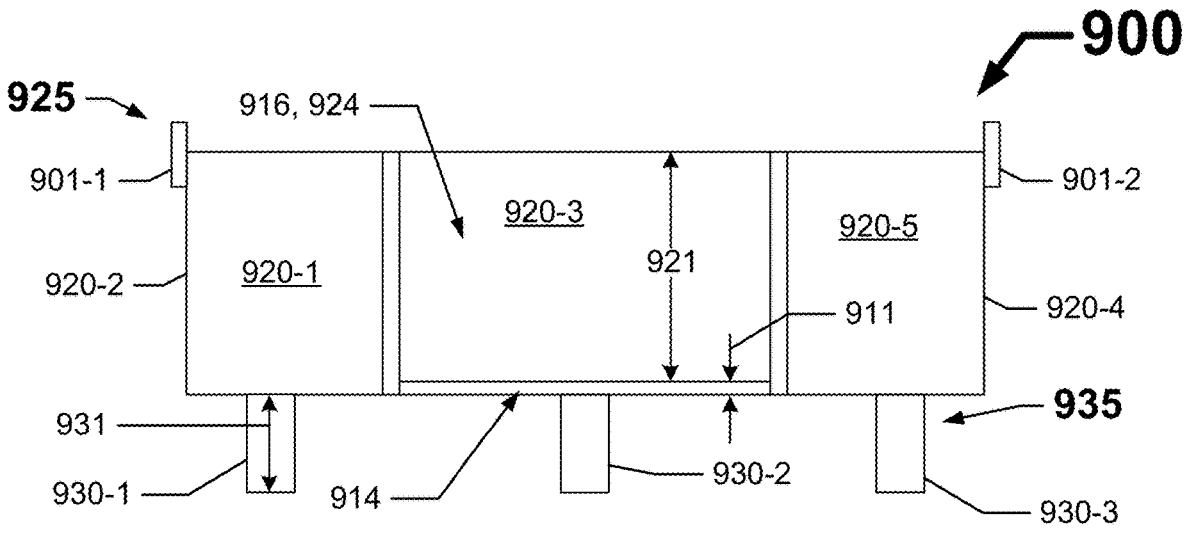
FIGS. 9A and 9B show an alternative example casing running rotary insert according to certain example embodiments.
Figure 9B:
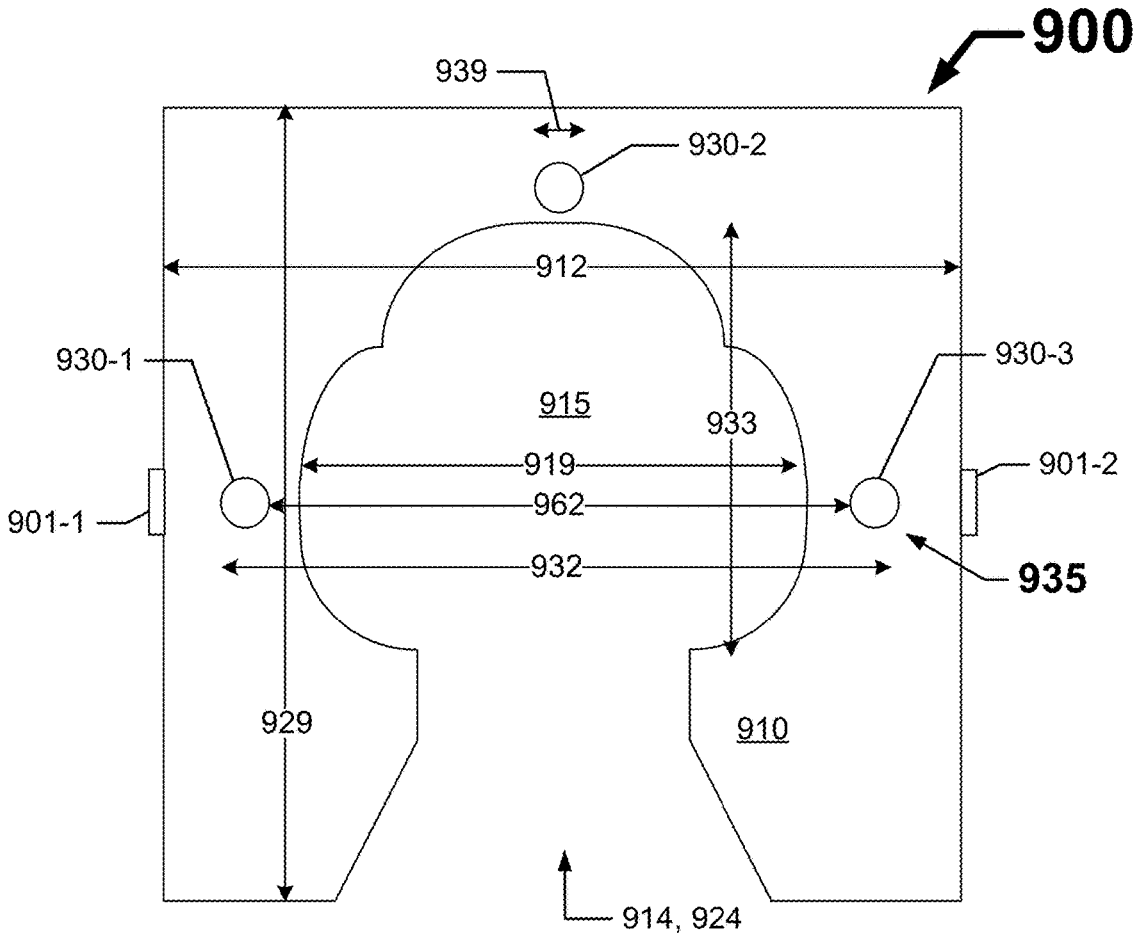

FIGS. 9A and 9B show an alternative example casing running rotary insert 900 according to certain example embodiments. Specifically, FIG. 9A shows a front view of the casing running rotary insert 900. FIG. 9B shows a bottom view of the casing running rotary insert 900. Referring to the description above with respect to FIGS. 1 through 8B, the casing running rotary insert 900 of FIGS. 9A and 9B is another example of the casing running rotary insert 100 discussed above with respect to FIG. 1 and is designed to complement the rotary table 840 of FIGS. 8A and 8B above. In this case, the casing running rotary insert 900 of FIGS. 9A and 9B may be substantially the same as the casing running rotary insert 400 discussed above with respect to FIGS. 4A through 4C, except as described below.

For example, the casing running rotary insert 900 of FIGS. 8A and 8B includes a base 910, a rotary table engagement feature 935 that extends from the bottom of the base 910, and a casing bowl engagement feature 925 that extends from the top of the base 910. The casing running rotary insert 900 in this case also includes two lifting mechanism receiving features 901 (lifting mechanism receiving feature 901-1 and lifting mechanism receiving feature 901-2) that are configured to receive part (e.g., a cable) of a lifting mechanism (e.g., a crane) for moving the casing running rotary insert 900.

Figure 10A:
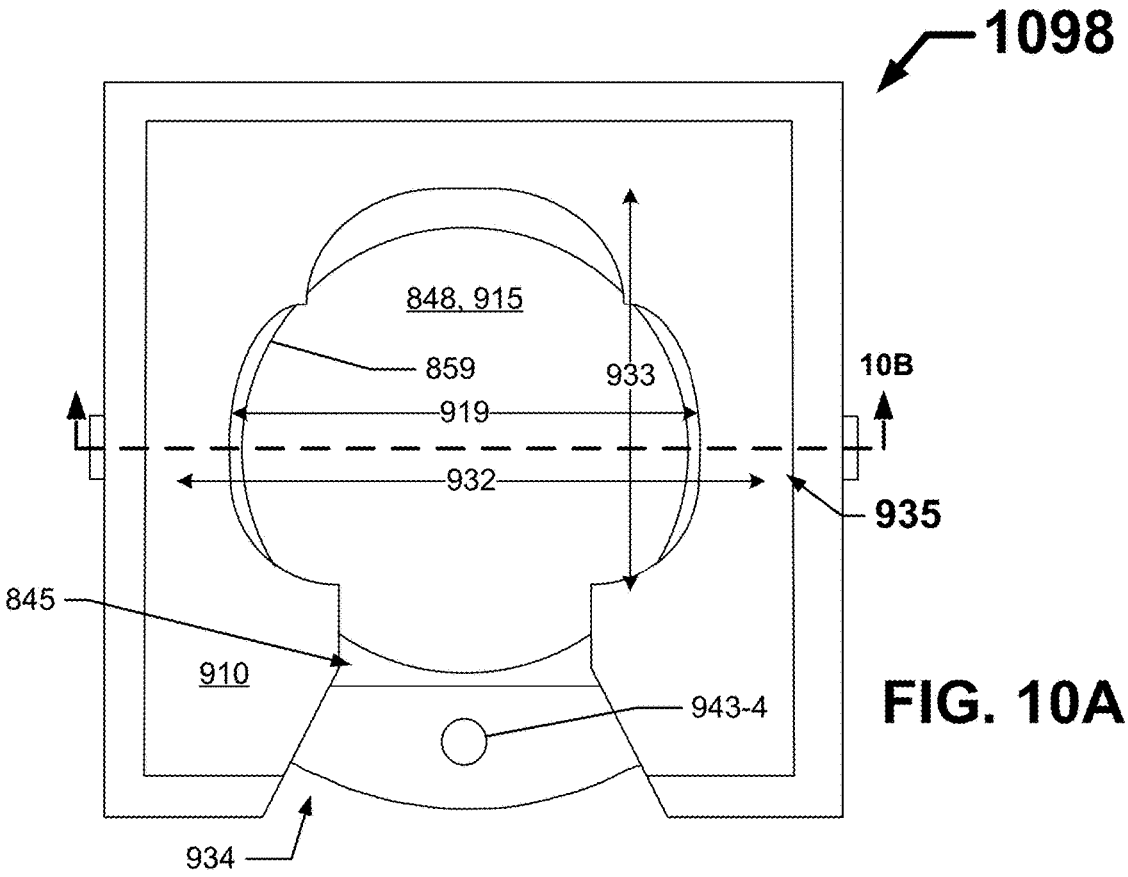
FIGS. 10A and 10B show various views of a subassembly that includes the rotary table of FIGS. 8A and 8B and the example casing running rotary insert of FIGS. 9A and 9B according to certain example embodiments.
Figure 10B:
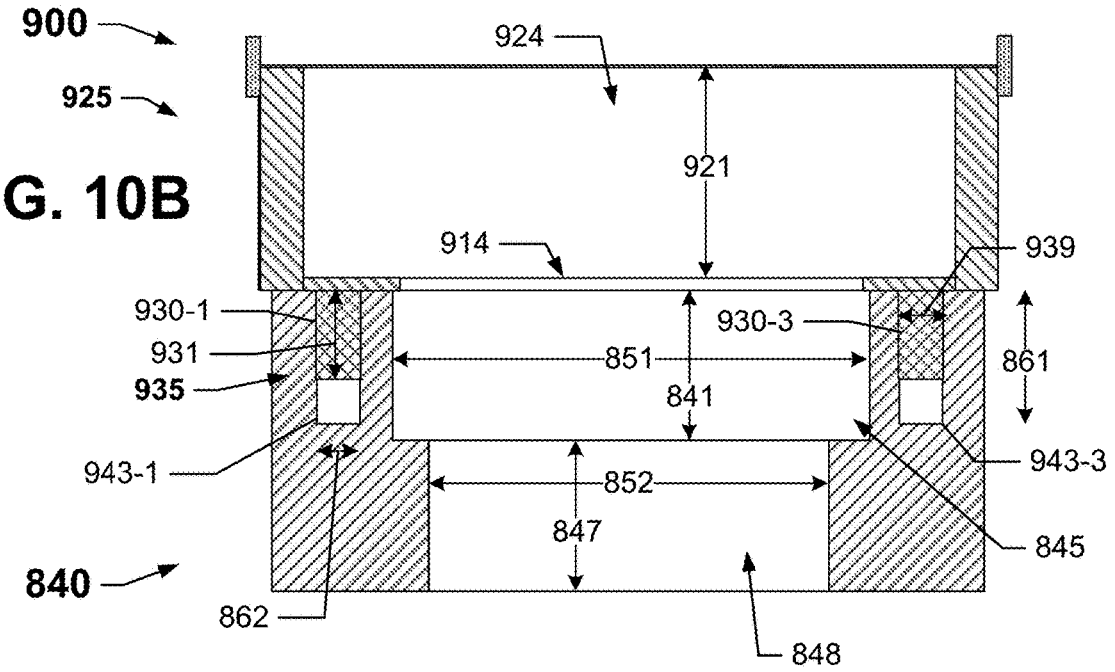

The base 910 of the casing running rotary insert 900 includes an aperture 915 that traverses the thickness 911 of the base 910. The lengthwise axis of the aperture 915 in this case is substantially coincident with the substantial center of the base 910. The aperture 915 in this case is clover-shaped when viewed from above. The aperture 915 has a width 919 that is substantially the same as the length 933 of the aperture 915. As shown in FIGS. 10A and 10B below, the aperture 915 is designed to coincide with the aperture 848 in a rotary table 840 (and also the aperture (e.g., aperture 385) in the casing bowl (e.g., casing bowl 380). The thickness 911 of the base 910 in this case is substantially uniform throughout, making the base 910 planar. When viewed from above, the base 910 in this case is substantially square such that the width 912 of the base is substantially the same as the length 929 of the base 910.

In this example, the base 910 includes one relief feature 914 (also sometimes called an aperture relief feature 914), which is configured to allow fluids (e.g., oil, working fluid, water) that flow up from the rotary table 840, out of a casing string (e.g., casing string 790), and/or out of some other component of a system used to assemble or disassemble a casing string away from the casing running rotary insert 900. A relief feature 914 may additionally or alternatively provide mechanical stress relief as various forces are applied to the base 910 of the casing running rotary insert 900 during field operations (e.g., making up a tubing string, breaking out a tubing string). In this case, the relief feature 914 is in the form of an opening that spans from the aperture 915 that traverses the thickness 911 of the base 910 to an outer perimeter of the base 910 at the front.

The rotary table engagement features 935 of the casing running rotary insert 900 of FIGS. 9A and 9B extends from the bottom surface of the base 910. The rotary table engagement feature 935 is configured to engage (in this case, fit within) the casing running rotary insert engagement features 943 of the rotary table 840. When this occurs, the rotary table engagement feature 935 fixes the position of the base 910 (and the rest of the casing running rotary insert 900) relative to the rotary table 840. As shown below with respect to FIGS. 10A and 10B, the aperture 915 in the base 910 aligns with the aperture 848 in the rotary table 840 when the rotary table engagement feature 935 is engaged with the casing running rotary insert engagement features 943 of the rotary table 840. In this example, the rotary table engagement feature 935 has no overlap with the aperture 915 that traverses the thickness 911 of the base 910.

In this case, the rotary table engagement feature 935 of the casing running rotary insert 900 has three components 930 (component 930-1, component 930-2, and component 930-3) that are in the form of cylindrical protrusions that are positioned around three sides of the perimeter of the aperture 915 that traverses the thickness 911 of the base 910 along the bottom surface of the base 910. In this case, each of the three rotary table engagement feature components 930 has a height 931 and width 939 that are configured to be no greater than the depth 861 and width 862, respectively, of the corresponding casing running rotary insert engagement features 943 of the rotary table 840. The configuration (e.g., length, width, depth) of each component 930 of the rotary table engagement feature 935 is substantially the same as each other. In this example, because the components 930 are discrete and independent of each other, the rotary table engagement feature 935 does not have an express relief feature (e.g., relief feature 434).

In this configuration of the rotary table engagement feature 935, the components 930 of the rotary table engagement feature 935 has a width 962 (defined between the inner surfaces of component 930-1 and component 930-3) and a height 931 (defined between the height 931 of each of the components 930 of the rotary table engagement feature 935). The width 962 is at least as great as the width 919 of the aperture 915 that traverses the base 910. The overall width 932 (defined between the outer surfaces of component 930-1 and component 930-3) of the rotary table engagement feature 935 in this case is less than the overall width 912 of the base 910.

The casing bowl engagement feature 925 of the casing running rotary insert 900 in this case is substantially the same as the casing bowl engagement feature 425 of the casing running rotary insert 400 of FIGS. 4A through 4C. For example, the casing bowl engagement feature 925 of the casing running rotary insert 900 extends from the top surface of the base 910. The casing bowl engagement feature 925 is configured to engage a casing bowl (e.g., casing bowl 380) in order to fix the position of the casing bowl relative to the base 910 of the casing running rotary insert 900. The casing bowl engagement feature 925 is configured in such a way that the aperture 915 in the base 910 aligns with the aperture (e.g., aperture 385) in the casing bowl when the casing bowl engagement feature 925 is engaged with the casing bowl. In this case, the casing bowl engagement feature 925 is also configured to have no overlap with the aperture 915 that traverses the thickness 911 of the base 910.

In this example, the casing bowl engagement feature 925 of the casing running rotary insert 900 has five components 920 (component 920-1, component 920-2, component 920-3, component 920-4, and component 920-5) that are in the form of walls positioned around most of the outer perimeter of the base 910 along the top surface of the base 910. The configuration (e.g., shape, size) of component 920-2, component 920-3, and component 920-4 are substantially the same as each other. Similarly, the configuration of component 920-1 and component 920-5 are substantially the same as each other and have a shorter length than the width 912 of component 920-2, component 920-3, and component 920-4. Each component 920 of the casing bowl engagement feature 925 has a height 921.

In this configuration of the casing bowl engagement feature 925, component 920-1 and component 920-2 are coupled to each other to form substantially a right angle, component 920-2 and component 920-3 are coupled to each other to form substantially a right angle, component 920-3 and component 920-4 are coupled to each other to form substantially a right angle, and component 920-4 and component 920-5 are coupled to each other to form substantially a right angle. In this configuration, the components 920 of the casing bowl engagement feature 925 form a cavity 916 having an open top end, a mostly open front side (in the form of a relief feature 924), a mostly open bottom (in the form of the aperture 915 in the base 910), a width (defined between the inner surfaces of component 920-2 and component 920-4), a length (defined between the inner surfaces of component 920-3 and either component 920-1 or component 920-5), and a height (defined between the height of each of the components 920 of the casing bowl engagement feature 925).

The overall width 912 (defined between the outer surfaces of component 920-2 and component 920-4) of the casing bowl engagement feature 925 in this case is the same as the overall width 912 of the base 910, and the overall length 929 (defined between the outer surfaces of component 920-3 and either component 920-1 or component 920-5) of the casing bowl engagement feature 925 in this case is the same as the overall length 929 of the base 910.

The casing bowl engagement feature 925 in this case includes a relief feature 924 (also sometimes called a casing bowl engagement relief feature 924) by virtue of the opening between component 920-1 and component 920-5 that traverses their height. The relief feature 924 of the casing bowl engagement feature 925 in this case is in the form of an opening that is coincident with the relief feature 914 of the base 910. Specifically, the relief feature 924 of the casing bowl engagement feature 925 coincides with the relief feature 914 of the base 910, which spans from the aperture 915 that traverses the base 910 to the outer perimeter of the base 910.

FIGS. 10A and 10B show various views of a subassembly 1098 that includes the rotary table 840 of FIGS. 8A and 8B and the example casing running rotary insert 900 of FIGS. 9A and 9B according to certain example embodiments. Specifically, FIG. 10A shows a top view of the subassembly 1098, and FIG. 10B shows a cross-sectional front view of the subassembly 1098. Referring to the description above with respect to FIGS. 1 through 9B, the subassembly 1098 of FIGS. 10A and 10B show that the rotary table engagement feature 935 of the casing running rotary insert 900 is engaged with the casing running rotary insert engagement features 943 of the rotary table 840.

Specifically, component 930-1 of the rotary table engagement feature 935 of the casing running rotary insert 900 is inserted into the casing running rotary insert engagement feature 943-1 of the rotary table 840, component 930-2 of the rotary table engagement feature 935 of the casing running rotary insert 900 is inserted into the casing running rotary insert engagement feature 943-2 of the rotary table 840, and component 930-3 of the rotary table engagement feature 935 of the casing running rotary insert 900 is inserted into the casing running rotary insert engagement feature 943-3 of the rotary table 840.

In this case, the width 939 (in this case, circumference) of each component 930 of the rotary table engagement feature 935 of the casing running rotary insert 900 is no greater (e.g., slightly less) than the width 862 (in this case, circumference) of the corresponding casing running rotary insert engagement feature 943-3 of the rotary table 840. Similarly, the depth 861 of each casing running rotary insert engagement feature 943 of the rotary table 840 is slightly larger than the height 931 of the corresponding components 930 of the rotary table engagement feature 935 of the casing running rotary insert 900.

When the rotary table engagement feature 935 of the casing running rotary insert 900 is engaged with the casing running rotary insert engagement features 943 of the rotary table 840, there is a substantially continuous aperture through the subassembly 1098. Specifically, the aperture 915 that traverses the base 910 of the casing running rotary insert 900 merges with the recessed area 845 and the aperture 848 that traverses the body 855 of the rotary table 840.

In this case, the width 919 of the aperture 915 in the base 910 may be substantially the same as, or different than, the width 851 of the recessed area 845 of the rotary table 840, which may be substantially the same as, or different than, the width 852 of the aperture 848 that traverses the body 855 of the rotary table 840. Similarly, the various fluid relief features of the subassembly 1098 are aligned with each other. Specifically, the relief feature 924 of the casing bowl engagement feature 925 coincides with the relief feature 914 of the base 910, which spans from the aperture 915 that traverses the base 910 to the outer perimeter of the base 910 at the front.

Figure 11:
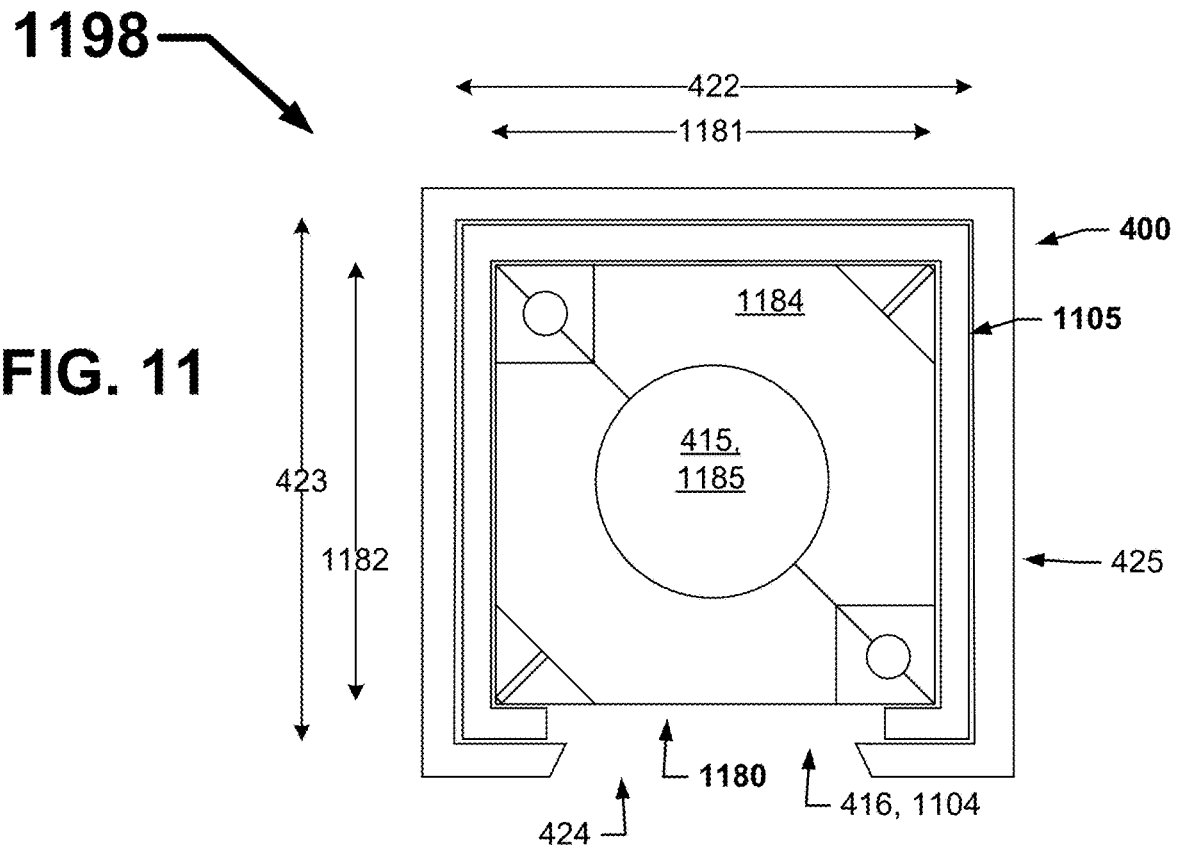
FIGS. 11 and 12 show various subassemblies that include casing running rotary inserts with separate compensation devices according to certain example embodiments.
Figure 12:
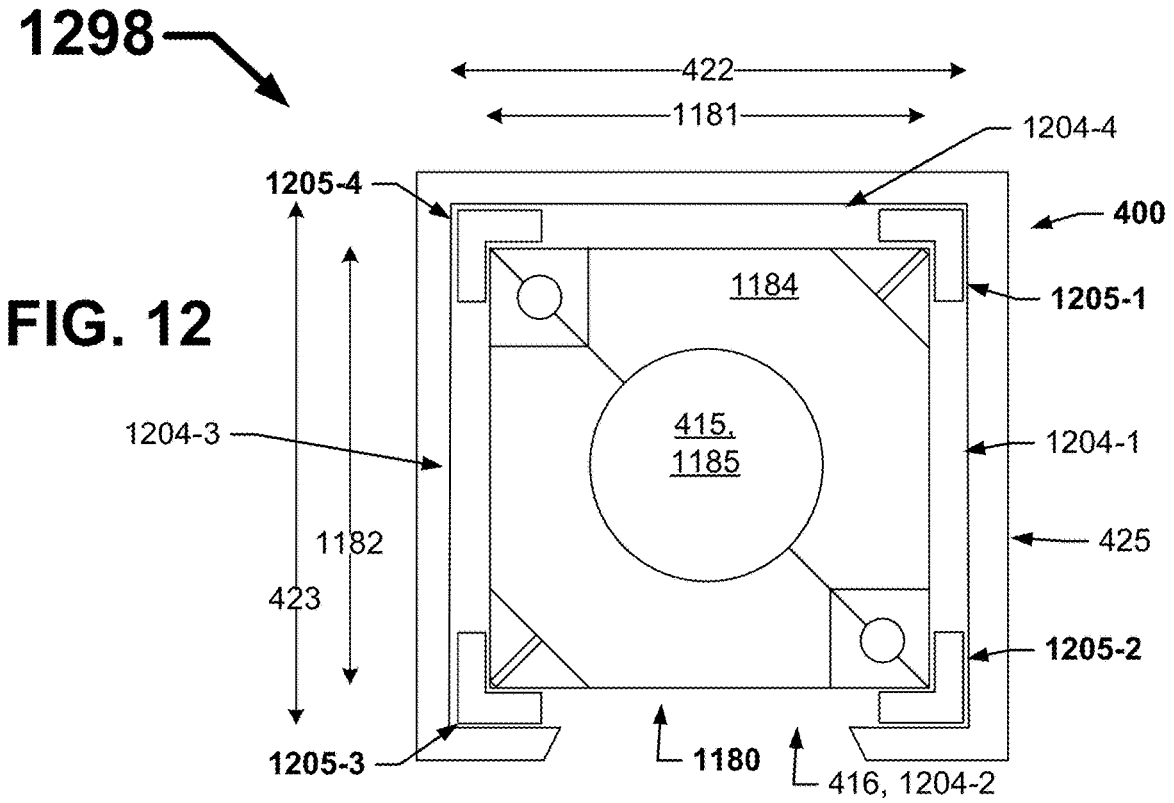

FIGS. 11 and 12 show various subassemblies that include example casing running rotary inserts with compensation devices according to certain example embodiments. Referring to the description above with respect to FIGS. 1 through 10B, FIG. 11 shows a top view of a subassembly 1198 that includes the casing running rotary insert 400 of FIGS. 4A through 4C, a casing bowl 1180, and a compensation device 1105. The casing bowl 1180 of FIG. 11 is substantially the same as the casing bowl 380 discussed above, except that in this case the casing bowl 1180 of FIG. 11 has a length 1182 that is less than the length 382 of the casing bowl 380 of FIGS. 3A and 3B, and the casing bowl 1180 of FIG. 11 has a width 1181 that is less than the width 381 of the casing bowl 380 of FIGS. 3A and 3B.

As a result, when the casing bowl 1180 is positioned inside the cavity 416 formed by the casing bowl engagement feature 425, the casing bowl 1180 may not be completely secure. For example, the casing bowl 1180 may slide around within the cavity 416, which may cause a misalignment between the aperture 1185 that traverses the body 1184 of the casing bowl 1180 and the aperture 415 that traverses the base of the casing running rotary insert 400, the recessed area (e.g., recessed area 845) that traverses the top portion of the rotary table (e.g., rotary table 840), and/or the aperture (e.g., aperture 848) that traverses the bottom portion of the rotary table. When this occurs, the tubing string (e.g., tubing string 790) may become bent and/or otherwise damaged.

This problem may easily arise when the size of the casing bowl 1180 may vary, for example, based on the manufacturer of the casing bowl 1180 and/or the outer diameter of the tubing pipes (e.g., tubing pipes 792). In addition, or in the alternative, the size (e.g., the length 423, the width 422) of the casing bowl engagement feature 425 may be fixed and set for a large size so that a situation does not arise where the casing bowl 1180 cannot fit within the cavity 416 formed by the casing bowl engagement feature 425.

To solve this problem, one or more compensation devices 1105 may be added. A compensation device 1105 is a component that may be inserted between the casing bowl 1180 and the casing bowl engagement feature 425 within the cavity 416. A compensation device 1105 may have any characteristics (e.g., shape, size, material) needed to fill some or all of the gap within the cavity 416 between the casing bowl 1180 and the casing bowl engagement feature 425. For example, in the subassembly 1198 of FIG. 11, the compensation device 1105 is in a five-walled configuration that is similar to the configuration of the five components (e.g., components 420) of the casing bowl engagement feature 425.

In some cases, a compensation device may have one or more relief features that are similar to the relief features (e.g., relief feature 424) discussed above with respect to the casing bowl engagement feature 425. For example, as in the subassembly 1198 of FIG. 11 where there is a single compensation device 1105 that is a single piece, the compensation device 1105 has a relief feature 1104 in the form of a gap between the two planar walls of short length at the front. In this way, the relief feature 1104 of the compensation device 1105 is substantially similar to the relief feature 424 of the casing bowl engagement feature 425. Also, the relief feature 1104 of the compensation device 1105 is aligned with the relief feature 424 of the casing bowl engagement feature 425.

While not shown in FIG. 11, the compensation device 1105 may include one or more lifting mechanism receiving features (e.g., lifting mechanism receiving features 401) to help move the compensation device 1105. The compensation device 1105 may be positioned within the cavity 416 formed by the casing bowl engagement feature 425 either before or after the casing bowl 1180 is positioned within the cavity 416 formed by the casing bowl engagement feature 425.

FIG. 12 shows a top view of a subassembly 1298 that includes the casing running rotary insert 400 of FIGS. 4A through 4C, the casing bowl 1180 of FIG. 11, and four compensation devices 1205 (compensation device 1205-1, compensation device 1205-2, compensation device 1205-3, and compensation device 1205-4). As a result, the casing bowl 1180 of FIG. 12 has a length 1182 that is less than the length 382 of the casing bowl 380 of FIGS. 3A and 3B, and the casing bowl 1180 of FIG. 12 has a width 1181 that is less than the width 381 of the casing bowl 380 of FIGS. 3A and 3B.

As a result, when the casing bowl 1180 is positioned inside the cavity 416 formed by the casing bowl engagement feature 425, the casing bowl 1180 may not be completely secure. For example, the casing bowl 1180 may slide around within the cavity 416. To solve this problem in this case, the four compensation devices 1205 may be added. The compensation devices 1205 of FIG. 12 are configured (e.g., shape, size, material) substantially the same as each other as an elongated corner bracket. There is one compensation device 1205 that is positioned between each corner of the casing bowl 1180 and each corner of the casing bowl engagement feature 425.

Since the length and width of each compensation device 1205 is relatively small, the large gap between adjacent compensation devices 1205 may be considered types of relief features 1204. In this case, relief feature 1204-1 is in the gap between compensation device 1205-1 and compensation device 1205-2. Relief feature 1204-2 is at the front of the casing running rotary insert 400 in the gap between compensation device 1205-2 and compensation device 1205-3. Relief feature 1204-3 is in the gap between compensation device 1205-3 and compensation device 1205-4. Relief feature 1204-4 is in the gap between compensation device 1205-4 and compensation device 1205-1.

While not shown in FIG. 12, each compensation device 1205 may include one or more lifting mechanism receiving features (e.g., lifting mechanism receiving features 401) to help move the compensation device 1205. Each compensation device 1205 may be positioned within the cavity 416 formed by the casing bowl engagement feature 425 either before or after the casing bowl 1180 is positioned within the cavity 416 formed by the casing bowl engagement feature 425.

Figure 13A:
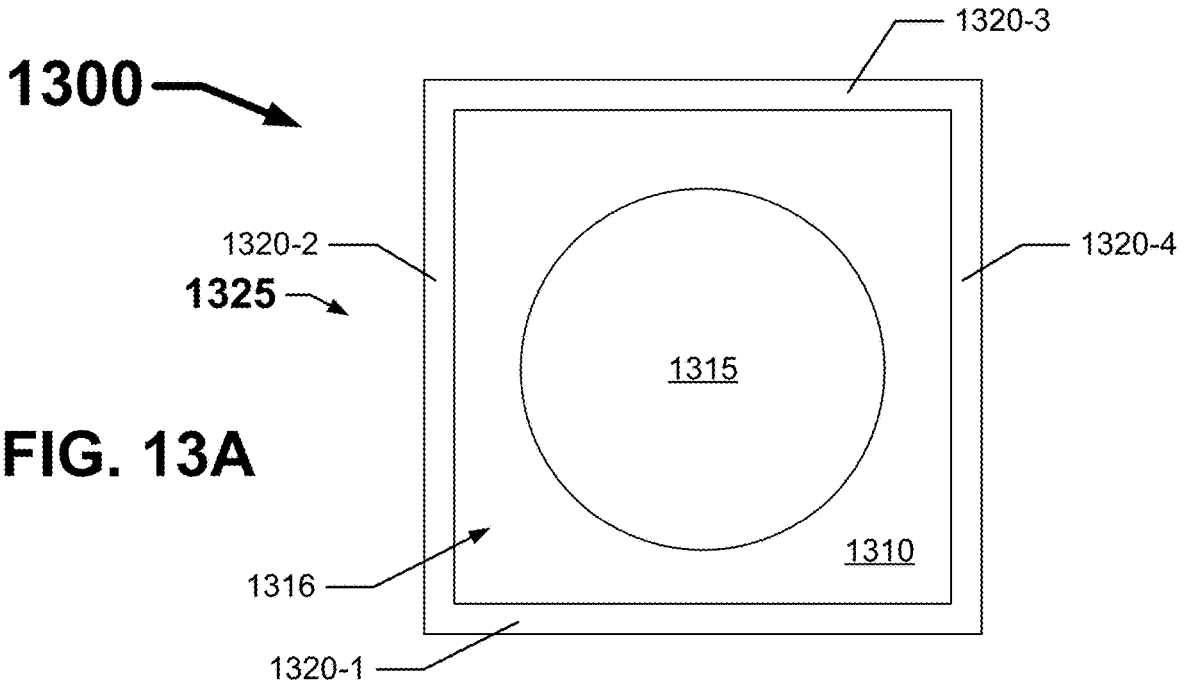
FIGS. 13A through 13C show an example casing running rotary insert with various casing bowl engagement relief features according to certain example embodiments.
Figure 13B:
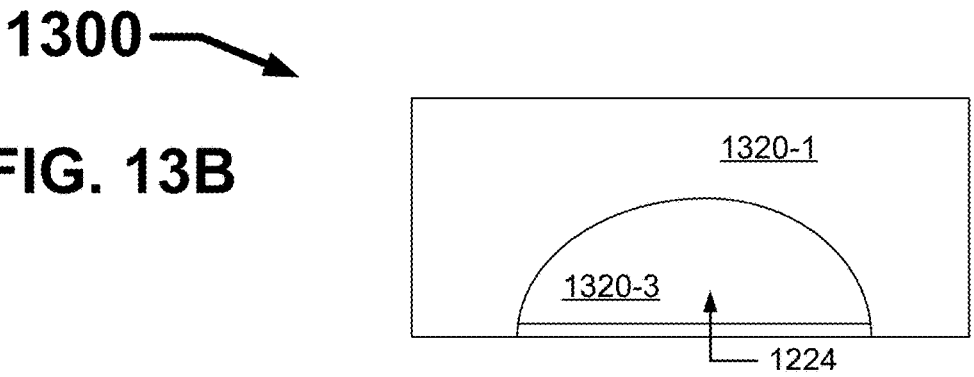
Figure 13C:
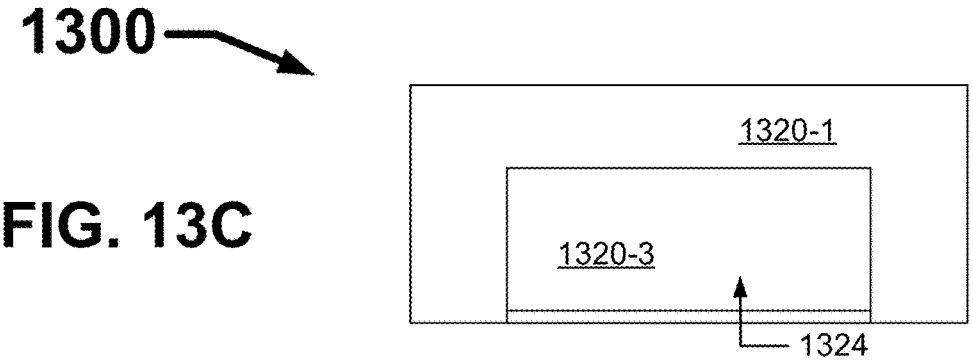

FIGS. 13A through 13C show an example casing running rotary insert 1300 with various casing bowl engagement relief features according to certain example embodiments. Specifically, FIG. 13A shows a top view of the casing running rotary insert 1300. FIG. 13B shows a front view of one embodiment of the casing running rotary insert 1300. FIG. 13C shows another embodiment of the casing running rotary insert 1300. Referring to the description above with respect to FIGS. 1 through 12, the casing running rotary insert 1300 shown in FIG. 13A is substantially similar to the casing running rotary insert 400 of FIGS. 4A through 4C.

For example, the casing running rotary insert 1300 in this case includes a base 1310 with an aperture 1315 that traverses therethrough. The base 1310 has no relief feature (e.g., relief feature 414) in this case. The casing running rotary insert 1300 in this case also includes a casing bowl engagement feature 1325 that has four components 1320 (component 1320-1, component 1320-2, component 1320-3, and component 1320-4) in the form of adjacent walls having substantially similar lengths, widths, and heights as each other. The four components 1320 form a cavity 1316 into which a casing bowl (e.g., casing bowl 380) may be positioned.

In this example, rather than one or more relief features (e.g., relief feature 424) being an opening in the front component where the opening traverses the entire height of the wall, the relief feature has different configurations. In FIG. 13B, the relief feature 1224 in the component 1320-1 is in the form of a semi-circle with the base at the bottom of the component 1320-1 and the top of the relief feature 1224 reaching about halfway along the height of the component 1320-1. In FIG. 13C, the relief feature 1324 in the component 1320-1 is in the form of a rectangle that has a width that is about ⅔ the width of the component 1320-1 and a height that is about ⅔ the height of the component 1320-1. In both cases, the other components 1320 (e.g., 1320-3) of the casing bowl engagement feature 1325 have no relief features.

Figure 14A:
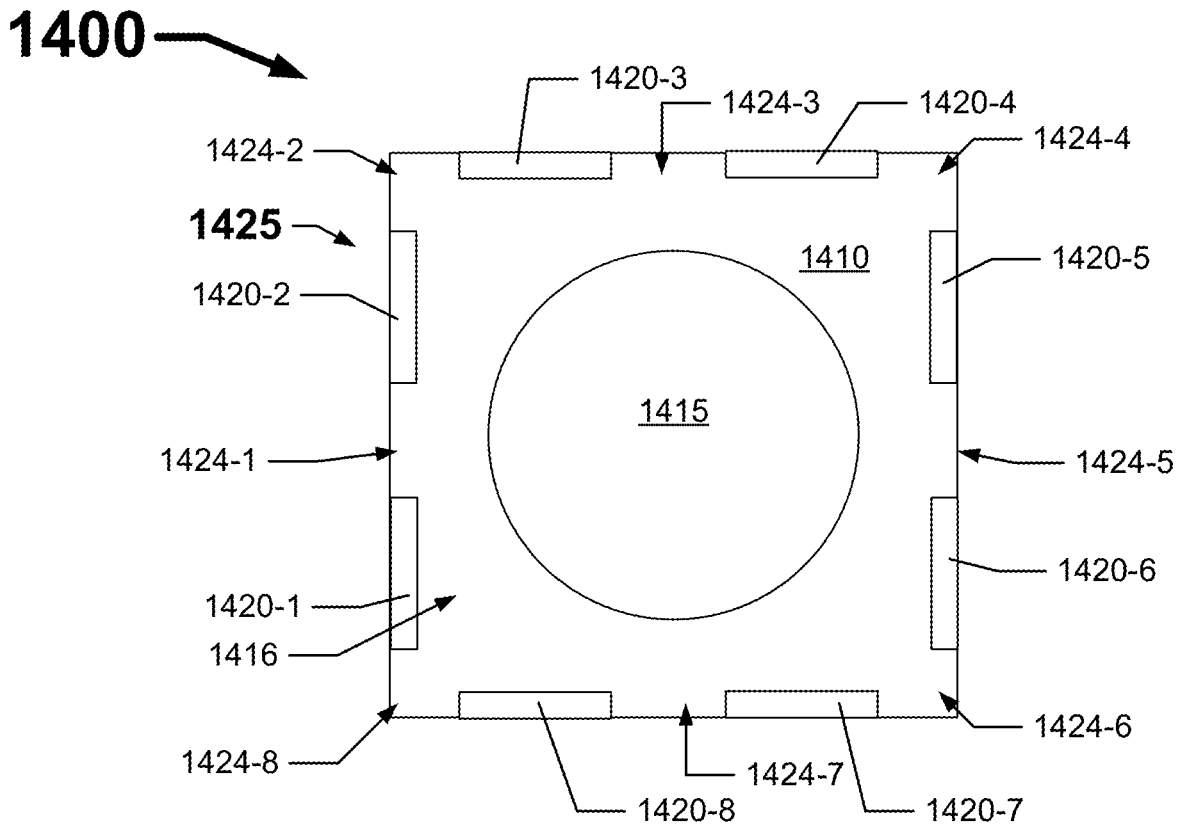
FIGS. 14A and 14B show various views of another example casing running rotary insert according to certain example embodiments.
Figure 14B:
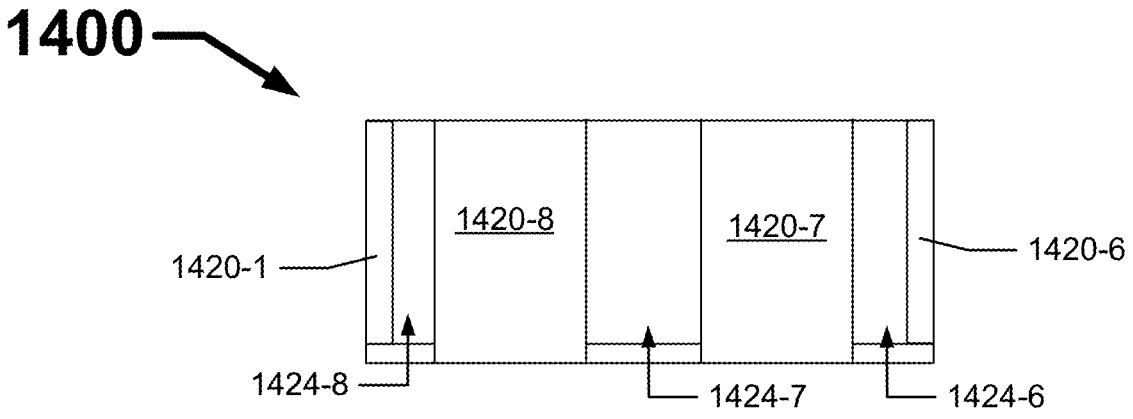

FIGS. 14A and 14B show various views of another example casing running rotary insert 1400 according to certain example embodiments. Specifically, FIG. 14A shows a top view of the casing running rotary insert 1400, and FIG. 14B shows a front view of the casing running rotary insert 1400. Referring to the description above with respect to FIGS. 1 through 13C, the casing running rotary insert 1400 shown in FIGS. 14A and 14B is substantially similar to the casing running rotary insert 400 of FIGS. 4A through 4C, except as discussed below.

For example, the casing running rotary insert 1400 in this case includes a base 1410 with an aperture 1415 that traverses therethrough. The base 1410 has no relief feature (e.g., relief feature 414) in this case. The casing running rotary insert 1400 in this case also includes a casing bowl engagement feature 1425 that has eight components 1420 (component 1420-1, component 1420-2, component 1420-3, component 1420-4, component 1420-5, component 1420-6, component 1420-7, and component 1420-8) in the form of adjacent walls having substantially similar lengths, widths, and heights as each other. There are two components 1420 on each of the four sides (e.g., component 1420-7 and component 1420-8 form the front of the casing running rotary insert 1400). The eight components 1420 form a cavity 1416 into which a casing bowl (e.g., casing bowl 380) may be positioned.

Each gap between adjacent components 1420 forms a relief feature 1424. Specifically, the gap between component 1420-1 and component 1420-2 forms relief feature 1424-1. The gap between component 1420-2 and component 1420-3 forms relief feature 1424-2. The gap between component 1420-3 and component 1420-4 forms relief feature 1424-3. The gap between component 1420-4 and component 1420-5 forms relief feature 1424-4. The gap between component 1420-5 and component 1420-6 forms relief feature 1424-5. The gap between component 1420-6 and component 1420-7 forms relief feature 1424-6. The gap between component 1420-7 and component 1420-8 forms relief feature 1424-7. The gap between component 1420-8 and component 1420-1 forms relief feature 1424-8.

Figure 15A:
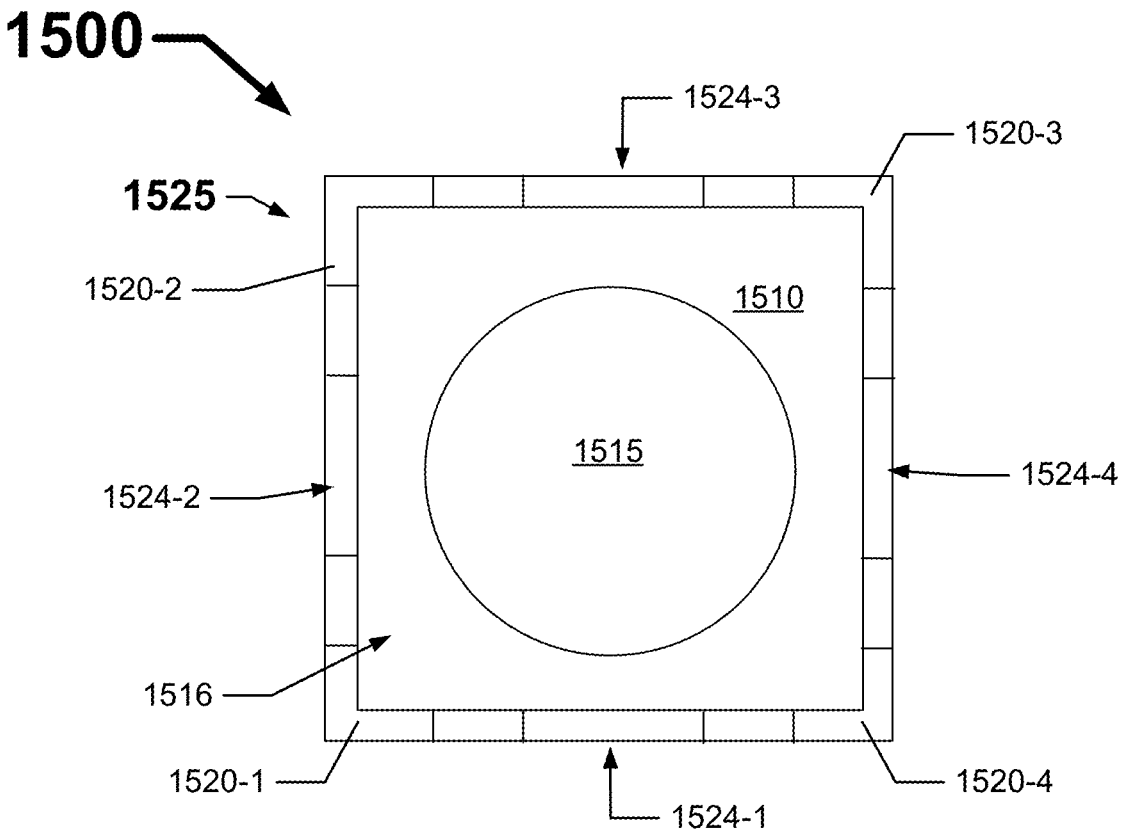
FIGS. 15A and 15B show various views of yet another example casing running rotary insert according to certain example embodiments.
Figure 15B:
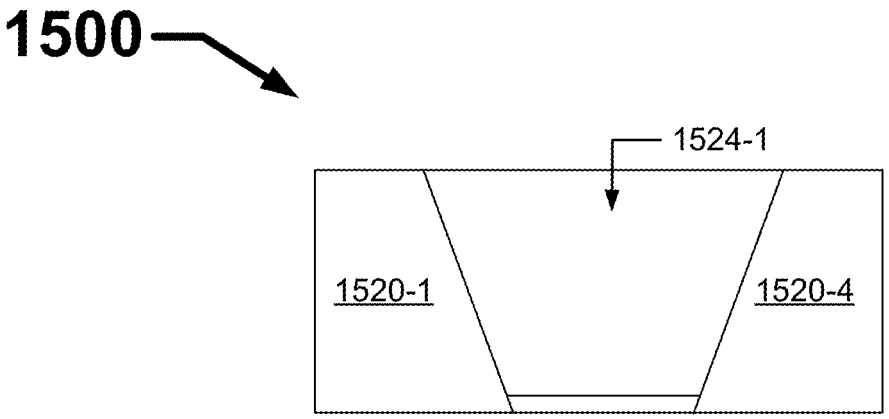

FIGS. 15A and 15B show various views of yet another example casing running rotary insert 1500 according to certain example embodiments. Specifically, FIG. 15A shows a top view of the casing running rotary insert 1500, and FIG. 15B shows a front view of the casing running rotary insert 1500. Referring to the description above with respect to FIGS. 1 through 14B, the casing running rotary insert 1500 shown in FIGS. 15A and 15B is substantially similar to the casing running rotary insert 400 of FIGS. 4A through 4C, except as discussed below.

For example, the casing running rotary insert 1500 in this case includes a base 1510 with an aperture 1515 that traverses therethrough. The base 1510 has no relief feature (e.g., relief feature 414) in this case. The casing running rotary insert 1500 in this case also includes a casing bowl engagement feature 1525 that has four components 1520 (component 1520-1, component 1520-2, component 1520-3, and component 1520-4 in the form of adjacent walls having substantially similar lengths, widths, planar angled side surfaces, and heights as each other. The middle of each components 1520 coincides with a corner of the casing bowl engagement feature 1525 and a corner of the base 1510 of the casing running rotary insert 1500. The four components 1520 form a cavity 1516 into which a casing bowl (e.g., casing bowl 380) may be positioned.

Each gap between adjacent components 1520 forms a relief feature 1524. Specifically, the gap between component 1520-1 and component 1520-2 forms relief feature 1524-1. The gap between component 1520-2 and component 1520-3 forms relief feature 1524-2. The gap between component 1520-3 and component 1520-4 forms relief feature 1524-3. Each relief feature 1524 in this case forms a general V shape with an elongated base that is roughly ⅓ the width of the base 1510.

Example embodiments can be used to provide a more efficient and safer environment when making up and breaking out a tubing string relative to a wellbore. Example embodiments can be installed and securely placed in a relatively negligible amount of time, imposing only minimal delays toward the start of a field operation. Example embodiments may be configured for a single use or multiple uses. Example embodiments may comply with applicable industry standards when used during field operations.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A casing running rotary insert comprising:

a base comprising a first aperture that traverses therethrough;

a rotary table engagement feature that extends from a bottom surface of the base, wherein the rotary table engagement feature is configured to engage a complementary feature of a rotary table to fix a position of the base relative to the rotary table, and wherein the aperture in the base is configured to align with a second aperture in the rotary table when the rotary table engagement feature is engaged with the complementary feature of the rotary table; and a casing bowl engagement feature that extends from a top surface of the base, wherein the casing bowl engagement feature is configured to engage an outer surface of a casing bowl to fix a position of the casing bowl relative to the base.

2. The casing running rotary insert of claim 1, further comprising:

a lifting mechanism receiving feature that is configured to receive part of a lifting mechanism for moving the casing running rotary insert.

3. The casing running rotary insert of claim 1, wherein the base is substantially planar.

4. The casing running rotary insert of claim 3, wherein the base has a fluid relief feature that spans from the aperture to an outer perimeter of the base.

5. The casing running rotary insert of claim 1, wherein the aperture that traverses the base is non-circular when viewed from above.

6. The casing running rotary insert of claim 1, wherein the rotary table engagement feature comprises three adjacent rotary table engagement feature components in the form of walls positioned around part of a perimeter of the aperture that traverses the base.

7. The casing running rotary insert of claim 6, wherein each of the three adjacent rotary table engagement feature components has a height that is configured to be no greater than a depth of the complementary feature of the rotary table.

8. The casing running rotary insert of claim 1, wherein the casing bowl engagement feature comprises five adjacent casing bowl engagement feature components in the form of walls positioned around part of a perimeter of the aperture that traverses the base.

9. The casing running rotary insert of claim 8, wherein two of the walls adjacent to each other have an opening therebetween that traverses their height, and wherein the opening is configured to allow fluid to flow therethrough.

10. The casing running rotary insert of claim 9, wherein the opening coincides with an additional opening in the base that spans from the aperture that traverses the base to an outer perimeter of the base, and wherein the opening in the base is configured to further allow the fluid to flow therethrough.

11. The casing running rotary insert of claim 8, wherein each of the walls has a first height that is configured to be less than a second height of the casing bowl.

12. The casing running rotary insert of claim 8, wherein opposing walls are separated by a distance that is greater than a width or a length of the casing bowl.

13. A casing running rotary insert assembly comprising:

a casing bowl having a height, a length, a width, and a first aperture that traverses therethrough along the height; and a casing running rotary insert comprising:

a base comprising a second aperture that traverses therethrough;

a rotary table engagement feature that extends from a bottom surface of the base, wherein the rotary table engagement feature is configured to engage a complementary feature of a rotary table to fix a position of the base relative to the rotary table, and wherein the second aperture in the base is configured to align with a third aperture in the rotary table when the rotary table engagement feature is engaged with the complementary feature of the rotary table; and a casing bowl engagement feature that extends from a top surface of the base, wherein the casing bowl engagement feature is configured to engage the casing bowl to fix a position of the casing bowl relative to the base, and wherein the first aperture and the second aperture align with each other when the casing bowl engagement feature engages the casing bowl.

14. The casing running rotary insert assembly of claim 13, wherein the height of the casing bowl exceeds a second height of the casing bowl engagement feature.

15. The casing running rotary insert assembly of claim 13, wherein the casing bowl engagement feature comprises a fluid relief feature that is configured to allow fluid to flow therethrough.

16. The casing running rotary insert assembly of claim 13, wherein the casing bowl further comprises a lifting mechanism receiving feature that is configured to receive part of a lifting mechanism for moving the casing bowl relative to the casing running rotary insert.

17. The casing running rotary insert assembly of claim 13, wherein the first aperture in the casing bowl and the second aperture in the base of the casing running rotary insert are configured to receive part of a casing string.

18. A casing string manipulation system comprising:

a casing bowl having a height, a length, a width, and a first aperture that traverses therethrough along the height;

a rotary table comprising a second aperture that traverses therethrough and a casing running rotary insert engagement feature;

a casing running rotary insert comprising:

a base comprising a third aperture that traverses therethrough;

a rotary table engagement feature that extends from a bottom surface of the base, wherein the rotary table engagement feature is configured to engage the casing running rotary insert engagement feature of the rotary table to fix a position of the base relative to the rotary table, and wherein the third aperture in the base is configured to align with the second aperture in the rotary table when the rotary table engagement feature is engaged with the casing running rotary insert engagement feature of the rotary table; and a casing bowl engagement feature that extends from a top surface of the base, wherein the casing bowl engagement feature is configured to engage the casing bowl to fix a position of the casing bowl relative to the base, and wherein the first aperture and the third aperture align with each other when the casing bowl engagement feature engages the casing bowl.

19. The casing string manipulation system of claim 18, further comprising:

a tubing string comprising a distal portion and a proximal portion, wherein the distal portion is disposed within the first aperture, the second aperture, and the third aperture, and wherein the distal portion and the proximal portion are rotatably coupled to each other;

a slip removably inserted into the first aperture of the casing bowl around the distal portion of the tubing string to affix the distal portion of the tubing string relative to the casing bowl; and a tong that is disposed around the proximal portion of the tubing string to rotate the proximal portion of the tubing string independently of the distal portion of the tubing string.

20. The casing string manipulation system of claim 19, wherein the tong rotates the proximal portion of the tubing string to couple the proximal portion of the tubing string to the distal portion of the tubing string at a first time to generate a subsequent distal portion of the tubing string, wherein the subsequent distal portion of the tubing string is lowered, after the slip is removed, until a top end of the subsequent distal portion of the tubing string is disposed within the first aperture, the second aperture, and the third aperture, wherein the slip is then reinserted into the first aperture of the casing bowl around the subsequent distal portion of the tubing string to affix the subsequent distal portion of the tubing string relative to the casing bowl, and wherein the tong is disposed around a second proximal portion of the tubing string to rotate the second proximal portion of the tubing string independently of the subsequent distal portion of the tubing string.

* * * * *